US006552736B2

(12) United States Patent
Honda et al.

(10) Patent No.: US 6,552,736 B2
(45) Date of Patent: Apr. 22, 2003

(54) DISPLAY PANEL DRIVING METHOD

(75) Inventors: Hirofumi Honda, Yamanashi (JP); Tetsuya Shigeta, Yamanashi (JP); Tetsuro Nagakubo, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 87 days.

(21) Appl. No.: 09/836,532

(22) Filed: Apr. 18, 2001

(65) Prior Publication Data

US 2002/0030672 A1 Mar. 14, 2002

(30) Foreign Application Priority Data

Apr. 18, 2000 (JP) ..... 2000-116972

(51) Int. Cl.[7] ..... G09G 3/28
(52) U.S. Cl. ..... 345/691; 345/63
(58) Field of Search ..... 345/60, 63, 68, 345/690, 691, 692; 315/169.1, 169.4

(56) References Cited

U.S. PATENT DOCUMENTS 5,757,343 A * 5/1998 Nagakubo ..... 345/63
6,037,917 A * 3/2000 Kawakami ..... 345/63
6,243,073 B1 * 6/2001 Kawamura et al. ..... 345/60
6,323,880 B1 * 11/2001 Yamada ..... 345/63
6,369,782 B2 * 4/2002 Shigeta ..... 345/63
6,396,508 B1 * 5/2002 Noecker ..... 345/63
6,448,960 B1 * 9/2002 Shigeta ..... 345/60

* cited by examiner

*Primary Examiner*—Xiao Wu
(74) *Attorney, Agent, or Firm*—Sughrue Mion, PLLC

(57) ABSTRACT

A display panel driving method capable of realizing a high definition gradation display while reducing power consumption. In each of a plurality of divisional display periods constituting a unit display period in a video signal, a pixel data writing stage is performed for setting each of pixel cells to either a light emitting cell or a non-light emitting cell in accordance with pixel data corresponding to the video signal, and a light emission sustain stage is performed for causing only the light emitting cells to emit light a number of light emissions allocated in correspondence to a weighting factor applied to each of the divisional display periods. A luminance distribution of the video signal is measured every display line on the display panel, and the number of divisional display periods in the unit display period is changed every display line in accordance with the luminance distribution.

15 Claims, 19 Drawing Sheets

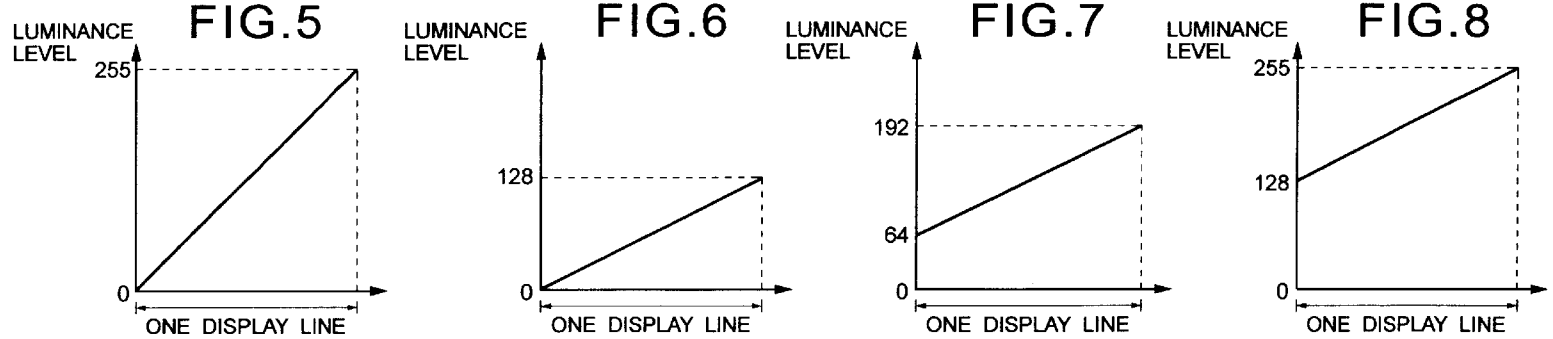
FIG.5
FIG.6
FIG.7
FIG.8
FIG.9
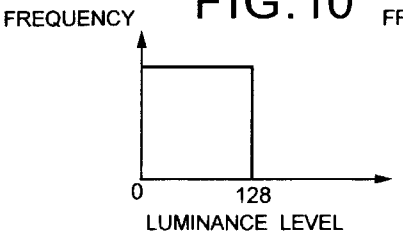
FIG.10
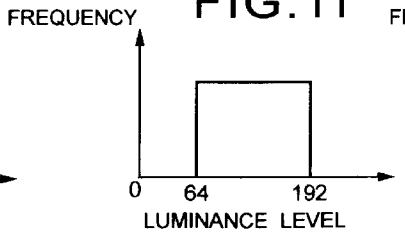
FIG.11
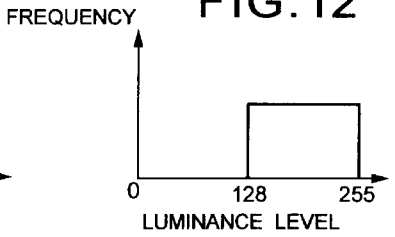
FIG.12
FIG.13
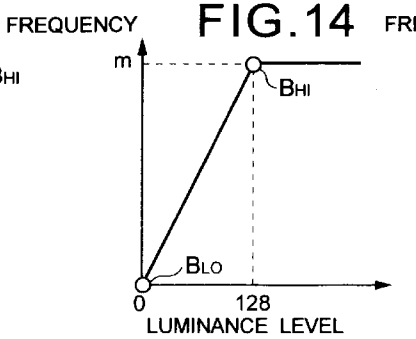
FIG.14
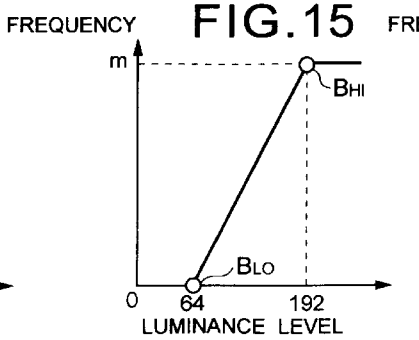
FIG.15
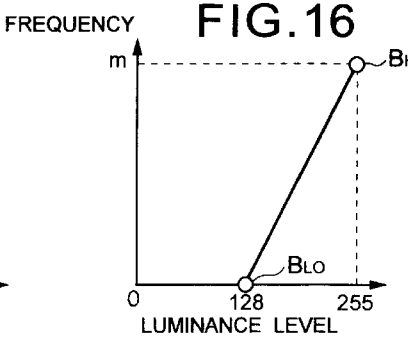
FIG.16

FIG.22

[ SELECTIVE ERASURE ]

GRADATION LEVEL

DISPLAY LUMINANCE

| | CONVERSION TABLE FOR SECOND DATA CONVERTER CIRCUIT 34 | | | | | | | | | | | LIGHT EMISSION DRIVING PATTERN | | | | | | | | | | |
|---|---|---|---|---|---|---|---|---|---|---|---|---|---|---|---|---|---|---|---|---|---|---|
| | Ds | GD 1 | 2 | 3 | 4 | 5 | 6 | 7 | 8 | 9 | 10 | SF 1 | SF 2 | SF 3 | SF 4 | SF 5 | SF 6 | SF 7 | SF 8 | SF 9 | SF 10 | (a) |
| 1 | 0000 | 1 | 0 | 0 | 0 | 0 | 0 | 0 | 0 | 0 | 0 | ● | ○ | ○ | ○ | ○ | ○ | ○ | ○ | ○ | ○ | 0 |
| 2 | 0001 | 0 | 1 | 0 | 0 | 0 | 0 | 0 | 0 | 0 | 0 | ○ | ● | ○ | ○ | ○ | ○ | ○ | ○ | ○ | ○ | 2 |
| 3 | 0010 | 0 | 0 | 1 | 0 | 0 | 0 | 0 | 0 | 0 | 0 | ○ | ○ | ● | ○ | ○ | ○ | ○ | ○ | ○ | ○ | 7 |
| 4 | 0011 | 0 | 0 | 0 | 1 | 0 | 0 | 0 | 0 | 0 | 0 | ○ | ○ | ○ | ● | ○ | ○ | ○ | ○ | ○ | ○ | 18 |
| 5 | 0100 | 0 | 0 | 0 | 0 | 1 | 0 | 0 | 0 | 0 | 0 | ○ | ○ | ○ | ○ | ● | ○ | ○ | ○ | ○ | ○ | 34 |
| 6 | 0101 | 0 | 0 | 0 | 0 | 0 | 1 | 0 | 0 | 0 | 0 | ○ | ○ | ○ | ○ | ○ | ● | ○ | ○ | ○ | ○ | 56 |
| 7 | 0110 | 0 | 0 | 0 | 0 | 0 | 0 | 1 | 0 | 0 | 0 | ○ | ○ | ○ | ○ | ○ | ○ | ● | ○ | ○ | ○ | 83 |
| 8 | 0111 | 0 | 0 | 0 | 0 | 0 | 0 | 0 | 1 | 0 | 0 | ○ | ○ | ○ | ○ | ○ | ○ | ○ | ● | ○ | ○ | 117 |
| 9 | 1000 | 0 | 0 | 0 | 0 | 0 | 0 | 0 | 0 | 1 | 0 | ○ | ○ | ○ | ○ | ○ | ○ | ○ | ○ | ● | ○ | 157 |
| 10 | 1001 | 0 | 0 | 0 | 0 | 0 | 0 | 0 | 0 | 0 | 1 | ○ | ○ | ○ | ○ | ○ | ○ | ○ | ○ | ○ | ● | 203 |
| 11 | 1010 | 0 | 0 | 0 | 0 | 0 | 0 | 0 | 0 | 0 | 0 | ○ | ○ | ○ | ○ | ○ | ○ | ○ | ○ | ○ | ○ | 255 |

BLACK CIRCLE : SELECTIVE ERASURE DISCHARGE
WHITE CIRCLE : LIGHT EMISSION

FIG.23

[ SELECTIVE ERASURE ]

| GRADATION LEVEL | CONVERSION TABLE FOR SECOND DATA CONVERTER CIRCUIT 34 | | | | | | LIGHT EMISSION DRIVING PATTERN | | | | | DISPLAY LUMINANCE | | |
|---|---|---|---|---|---|---|---|---|---|---|---|---|---|---|
| | Ds | GD 1 | 2 | 3 | 4 | 5 | SF 1 | SF 2 | SF 3 | SF 4 | SF 5 | (b) | (c) | (d) |
| 1 | 000 | 1 | 0 | 0 | 0 | 0 | ● | | | | | 0 | 0 | 0 |
| 2 | 001 | 0 | 1 | 0 | 0 | 0 | ○ | ● | | | | 2 | 44 | 83 |
| 3 | 010 | 0 | 0 | 1 | 0 | 0 | ○ | ○ | ● | | | 7 | 69 | 117 |
| 4 | 011 | 0 | 0 | 0 | 1 | 0 | ○ | ○ | ○ | ● | | 18 | 99 | 157 |
| 5 | 100 | 0 | 0 | 0 | 0 | 1 | ○ | ○ | ○ | ○ | ● | 34 | 136 | 203 |
| 6 | 101 | 0 | 0 | 0 | 0 | 0 | ○ | ○ | ○ | ○ | ○ | 255 | 255 | 255 |

BLACK CIRCLE : SELECTIVE ERASURE DISCHARGE
WHITE CIRCLE : LIGHT EMISSION

FIG.26

[ SELECTIVE ERASURE ]

| GRADATION LEVEL | CONVERSION TABLE FOR SECOND DATA CONVERTER CIRCUIT 34 | | | | | | | | | | | LIGHT EMISSION DRIVING PATTERN | | | | | | | | | | DISPLAY LUMINANCE |
|---|---|---|---|---|---|---|---|---|---|---|---|---|---|---|---|---|---|---|---|---|---|---|
| | Ds | GD 1 | 2 | 3 | 4 | 5 | 6 | 7 | 8 | 9 | 10 | SF 1 | SF 2 | SF 3 | SF 4 | SF 5 | SF 6 | SF 7 | SF 8 | SF 9 | SF 10 | (a) |
| 1 | 0000 | 1 | 1 | 0 | 0 | 0 | 0 | 0 | 0 | 0 | 0 | ● | ● | ○ | ○ | ○ | ○ | ○ | ○ | ○ | ○ | 0 |
| 2 | 0001 | 0 | 1 | 1 | 0 | 0 | 0 | 0 | 0 | 0 | 0 | ○ | ● | ● | ○ | ○ | ○ | ○ | ○ | ○ | ○ | 2 |
| 3 | 0010 | 0 | 0 | 1 | 1 | 0 | 0 | 0 | 0 | 0 | 0 | ○ | ○ | ● | ● | ○ | ○ | ○ | ○ | ○ | ○ | 7 |
| 4 | 0011 | 0 | 0 | 0 | 1 | 1 | 0 | 0 | 0 | 0 | 0 | ○ | ○ | ○ | ● | ● | ○ | ○ | ○ | ○ | ○ | 18 |
| 5 | 0100 | 0 | 0 | 0 | 0 | 1 | 1 | 0 | 0 | 0 | 0 | ○ | ○ | ○ | ○ | ● | ● | ○ | ○ | ○ | ○ | 34 |
| 6 | 0101 | 0 | 0 | 0 | 0 | 0 | 1 | 1 | 0 | 0 | 0 | ○ | ○ | ○ | ○ | ○ | ● | ● | ○ | ○ | ○ | 56 |
| 7 | 0110 | 0 | 0 | 0 | 0 | 0 | 0 | 1 | 1 | 0 | 0 | ○ | ○ | ○ | ○ | ○ | ○ | ● | ● | ○ | ○ | 83 |
| 8 | 0111 | 0 | 0 | 0 | 0 | 0 | 0 | 0 | 1 | 1 | 0 | ○ | ○ | ○ | ○ | ○ | ○ | ○ | ● | ● | ○ | 117 |
| 9 | 1000 | 0 | 0 | 0 | 0 | 0 | 0 | 0 | 0 | 1 | 1 | ○ | ○ | ○ | ○ | ○ | ○ | ○ | ○ | ● | ● | 157 |
| 10 | 1001 | 0 | 0 | 0 | 0 | 0 | 0 | 0 | 0 | 0 | 1 | ○ | ○ | ○ | ○ | ○ | ○ | ○ | ○ | ○ | ● | 203 |
| 11 | 1010 | 0 | 0 | 0 | 0 | 0 | 0 | 0 | 0 | 0 | 0 | ○ | ○ | ○ | ○ | ○ | ○ | ○ | ○ | ○ | ○ | 255 |

BLACK CIRCLE : SELECTIVE ERASURE DISCHARGE
WHITE CIRCLE : LIGHT EMISSION

FIG.27

[ SELECTIVE ERASURE ]

| GRADATION LEVEL | CONVERSION TABLE FOR SECOND DATA CONVERTER CIRCUIT 34 | | | | | | LIGHT EMISSION DRIVING PATTERN | | | | | DISPLAY LUMINANCE | | |
|---|---|---|---|---|---|---|---|---|---|---|---|---|---|---|
| | Ds | GD 1 | 2 | 3 | 4 | 5 | SF 1 | SF 2 | SF 3 | SF 4 | SF 5 | (b) | (c) | (d) |
| 1 | 000 | 1 | 1 | 0 | 0 | 0 | ● | ● | | | | 0 | 0 | 0 |
| 2 | 001 | 0 | 1 | 1 | 0 | 0 | ○ | ● | ● | | | 2 | 44 | 83 |
| 3 | 010 | 0 | 0 | 1 | 1 | 0 | ○ | ○ | ● | ● | | 7 | 69 | 117 |
| 4 | 011 | 0 | 0 | 0 | 1 | 1 | ○ | ○ | ○ | ● | ● | 18 | 99 | 157 |
| 5 | 100 | 0 | 0 | 0 | 0 | 1 | ○ | ○ | ○ | ○ | ● | 34 | 136 | 203 |
| 6 | 101 | 0 | 0 | 0 | 0 | 0 | ○ | ○ | ○ | ○ | ○ | 255 | 255 | 255 |

BLACK CIRCLE : SELECTIVE ERASURE DISCHARGE
WHITE CIRCLE : LIGHT EMISSION

FIG.29

[ SELECTIVE WRITE ]

| GRADATION LEVEL | CONVERSION TABLE FOR SECOND DATA CONVERTER CIRCUIT 34 | | | | | | | | | | | LIGHT EMISSION DRIVING PATTERN | | | | | | | | | | DISPLAY LUMINANCE |
|---|---|---|---|---|---|---|---|---|---|---|---|---|---|---|---|---|---|---|---|---|---|---|
| | Ds | GD 10 | 9 | 8 | 7 | 6 | 5 | 4 | 3 | 2 | 1 | SF 10 | SF 9 | SF 8 | SF 7 | SF 6 | SF 5 | SF 4 | SF 3 | SF 2 | SF 1 | (a) |
| 1 | 0000 | 0 | 0 | 0 | 0 | 0 | 0 | 0 | 0 | 0 | 0 | | | | | | | | | | | 0 |
| 2 | 0001 | 0 | 0 | 0 | 0 | 0 | 0 | 0 | 0 | 0 | 1 | | | | | | | | | | ● | 2 |
| 3 | 0010 | 0 | 0 | 0 | 0 | 0 | 0 | 0 | 0 | 1 | 0 | | | | | | | | | ● | ○ | 7 |
| 4 | 0011 | 0 | 0 | 0 | 0 | 0 | 0 | 0 | 1 | 0 | 0 | | | | | | | | ● | ○ | ○ | 18 |
| 5 | 0100 | 0 | 0 | 0 | 0 | 0 | 0 | 1 | 0 | 0 | 0 | | | | | | | ● | ○ | ○ | ○ | 34 |
| 6 | 0101 | 0 | 0 | 0 | 0 | 0 | 1 | 0 | 0 | 0 | 0 | | | | | | ● | ○ | ○ | ○ | ○ | 56 |
| 7 | 0110 | 0 | 0 | 0 | 0 | 1 | 0 | 0 | 0 | 0 | 0 | | | | | ● | ○ | ○ | ○ | ○ | ○ | 83 |
| 8 | 0111 | 0 | 0 | 0 | 1 | 0 | 0 | 0 | 0 | 0 | 0 | | | | ● | ○ | ○ | ○ | ○ | ○ | ○ | 117 |
| 9 | 1000 | 0 | 0 | 1 | 0 | 0 | 0 | 0 | 0 | 0 | 0 | | | ● | ○ | ○ | ○ | ○ | ○ | ○ | ○ | 157 |
| 10 | 1001 | 0 | 1 | 0 | 0 | 0 | 0 | 0 | 0 | 0 | 0 | | ● | ○ | ○ | ○ | ○ | ○ | ○ | ○ | ○ | 203 |
| 11 | 1010 | 1 | 0 | 0 | 0 | 0 | 0 | 0 | 0 | 0 | 0 | ● | ○ | ○ | ○ | ○ | ○ | ○ | ○ | ○ | ○ | 255 |

BLACK CIRCLE : SELECTIVE WRITE DISCHARGE + LIGHT EMISSION

WHITE CIRCLE : LIGHT EMISSION

FIG.30

[ SELECTIVE WRITE ]

GRADATION LEVEL

| | CONVERSION TABLE FOR SECOND DATA CONVERTER CIRCUIT 34 | | | | | | LIGHT EMISSION DRIVING PATTERN | | | | | DISPLAY LUMINANCE | | |
|---|---|---|---|---|---|---|---|---|---|---|---|---|---|---|
| | Ds | GD 5 | 4 | 3 | 2 | 1 | SF 5 | SF 4 | SF 3 | SF 2 | SF 1 | (b) | (c) | (d) |
| 1 | 000 | 0 | 0 | 0 | 0 | 0 | | | | | | 0 | 0 | 0 |
| 2 | 001 | 0 | 0 | 0 | 0 | 1 | | | | | ● | 2 | 44 | 83 |
| 3 | 010 | 0 | 0 | 0 | 1 | 0 | | | | ● | ○ | 7 | 69 | 117 |
| 4 | 011 | 0 | 0 | 1 | 0 | 0 | | | ● | ○ | ○ | 18 | 99 | 157 |
| 5 | 100 | 0 | 1 | 0 | 0 | 0 | | ● | ○ | ○ | ○ | 34 | 136 | 203 |
| 6 | 101 | 1 | 0 | 0 | 0 | 0 | ● | ○ | ○ | ○ | ○ | 255 | 255 | 255 |

BLACK CIRCLE : SELECTIVE WRITE DISCHARGE + LIGHT EMISSION

WHITE CIRCLE : LIGHT EMISSION

FIG.32

〔SELECTIVE WRITE〕

GRADATION LEVEL

DISPLAY LUMINANCE

| | CONVERSION TABLE FOR SECOND DATA CONVERTER CIRCUIT 34 | | | | | | | | | | | LIGHT EMISSION DRIVING PATTERN | | | | | | | | | | |
|---|---|---|---|---|---|---|---|---|---|---|---|---|---|---|---|---|---|---|---|---|---|---|
| | Ds | GD 10 | 9 | 8 | 7 | 6 | 5 | 4 | 3 | 2 | 1 | SF 10 | SF 9 | SF 8 | SF 7 | SF 6 | SF 5 | SF 4 | SF 3 | SF 2 | SF 1 | (a) |
| 1 | 0000 | 0 | 0 | 0 | 0 | 0 | 0 | 0 | 0 | 0 | 0 | | | | | | | | | | | 0 |
| 2 | 0001 | 0 | 0 | 0 | 0 | 0 | 0 | 0 | 0 | 0 | 1 | | | | | | | | | | ● | 2 |
| 3 | 0010 | 0 | 0 | 0 | 0 | 0 | 0 | 0 | 0 | 1 | 1 | | | | | | | | | ● | ● | 7 |
| 4 | 0011 | 0 | 0 | 0 | 0 | 0 | 0 | 0 | 1 | 1 | 0 | | | | | | | | ● | ● | ○ | 18 |
| 5 | 0100 | 0 | 0 | 0 | 0 | 0 | 0 | 1 | 1 | 0 | 0 | | | | | | | ● | ● | ○ | ○ | 34 |
| 6 | 0101 | 0 | 0 | 0 | 0 | 0 | 1 | 1 | 0 | 0 | 0 | | | | | | ● | ● | ○ | ○ | ○ | 56 |
| 7 | 0110 | 0 | 0 | 0 | 0 | 1 | 1 | 0 | 0 | 0 | 0 | | | | | ● | ● | ○ | ○ | ○ | ○ | 83 |
| 8 | 0111 | 0 | 0 | 0 | 1 | 1 | 0 | 0 | 0 | 0 | 0 | | | | ● | ● | ○ | ○ | ○ | ○ | ○ | 117 |
| 9 | 1000 | 0 | 0 | 1 | 1 | 0 | 0 | 0 | 0 | 0 | 0 | | | ● | ● | ○ | ○ | ○ | ○ | ○ | ○ | 157 |
| 10 | 1001 | 0 | 1 | 1 | 0 | 0 | 0 | 0 | 0 | 0 | 0 | | ● | ● | ○ | ○ | ○ | ○ | ○ | ○ | ○ | 203 |
| 11 | 1010 | 1 | 1 | 0 | 0 | 0 | 0 | 0 | 0 | 0 | 0 | ● | ● | ○ | ○ | ○ | ○ | ○ | ○ | ○ | ○ | 255 |

BLACK CIRCLE : SELECTIVE WRITE DISCHARGE + LIGHT EMISSION

WHITE CIRCLE : LIGHT EMISSION

FIG.33

[ SELECTIVE WRITE ]

| GRADATION LEVEL | CONVERSION TABLE FOR SECOND DATA CONVERTER CIRCUIT 34 | | | | | | LIGHT EMISSION DRIVING PATTERN | | | | | DISPLAY LUMINANCE | | |
|---|---|---|---|---|---|---|---|---|---|---|---|---|---|---|
| | Ds | GD 5 | 4 | 3 | 2 | 1 | SF 5 | SF 4 | SF 3 | SF 2 | SF 1 | (b) | (c) | (d) |
| 1 | 000 | 0 | 0 | 0 | 0 | 0 | | | | | | 0 | 0 | 0 |
| 2 | 001 | 0 | 0 | 0 | 0 | 1 | | | | | ● | 2 | 44 | 83 |
| 3 | 010 | 0 | 0 | 0 | 1 | 1 | | | | ● | ● | 7 | 69 | 117 |
| 4 | 011 | 0 | 0 | 1 | 1 | 0 | | | ● | ● | ○ | 18 | 99 | 157 |
| 5 | 100 | 0 | 1 | 1 | 0 | 0 | | ● | ● | ○ | ○ | 34 | 136 | 203 |
| 6 | 101 | 1 | 1 | 0 | 0 | 0 | ● | ● | ○ | ○ | ○ | 255 | 255 | 255 |

BLACK CIRCLE : SELECTIVE WRITE DISCHARGE + LIGHT EMISSION

WHITE CIRCLE : LIGHT EMISSION

DISPLAY PANEL DRIVING METHOD

BACKGROUND OF THE INVENTION

1. Field of the Invention

The present invention relates to a method for driving a plasma display panel in a matrix display scheme.

2. Description of Related Art

In recent years, a plasma display panel (hereinafter referred to as the "PDP"), an electroluminescent display panel (hereinafter referred to as the "ELDP") and so on have been brought into practical use as thin flat display panels of matrix display scheme. These PDP and ELDP have pixel cells, which function as pixels respectively, arranged in the form of a matrix comprised of n rows and m columns. The pixel cells have only two states: "light emission" and "non-light emission." Therefore, gradation driving based on a subfield method is conducted for a display panel such as the above-mentioned PDP and ELDP to provide a halftone luminance level corresponding to an input video signal.

The subfield method involves converting an input video signal into N-bit pixel data pixel by pixel. One field display period in the input video signal is constituted by N subfields each of which corresponds to each of N bit digits. A number of light emissions corresponding to each bit digit in the pixel data, is allocated to each of the subfields respectively. When a bit digit in the N bit is, for example, at logical level "1," light is emitted the number of times allocated as mentioned above in a subfield corresponding to the bit digit. On the other hand, when the bit digit is at logical level "0," no light is emitted in the subfield corresponding to the bit digit. The driving process using the subfield method stepwisely represents a halftone luminance level corresponding to an input video signal by a total number of light emissions which are performed in each of subfields within one field display period.

OBJECT AND SUMMARY OF THE INVENTION

It is an object of the present invention to provide a display panel driving method which realizes a good gradation display corresponding to an input video signal.

The present invention provides a display panel driving method for driving a display panel having a plurality of pixel cells arranged in matrix in accordance with a video signal. A unit display period in the video signal is constituted by a plurality of divisional display periods. In each of the divisional display periods, a pixel data writing stage is performed for setting each of the pixel cells to either a light emitting cell or a non-light emitting cell in accordance with pixel data corresponding to the video signal, and a light emission sustain stage is performed for causing only the light emitting cells to emit light a number of light emissions allocated thereto corresponding to a weighting factor applied to each of the divisional display periods. A luminance distribution of the video signal is measured every display line on the display panel, and the number of the divisional display periods in the unit display period is changed in accordance with the luminance distribution every display line.

BRIEF DESCRIPTION OF THE DRAWINGS

FIGS. 5 to 8 are graphs each showing an exemplary luminance level of a video signal on one display line;

FIGS. 9 to 12 are graphs each showing an exemplary frequency for each luminance level on one display line of a video signal;

FIGS. 13 to 16 are graphs each showing an exemplary accumulated frequency on one display line of a video signal;

FIG. 22 is a diagram showing a data conversion table employed by a second data converter circuit 34 and light emission driving patterns when a luminance distribution for pixel data of one display line falls under a pattern A in FIG. 4;

FIG. 23 is a diagram showing a data conversion table employed by the second data converter circuit 34 and light emission driving patterns when a luminance distribution for pixel data of one display line falls under any of patterns B–D in FIG. 4;

FIG. 26 is a diagram showing another example of a data conversion table employed by the second data converter circuit 34 and light emission driving patterns when a luminance distribution for pixel data of one display line falls under the pattern A in FIG. 4;

FIG. 27 is a diagram showing another example of a data conversion table employed by the second data converter circuit 34 and light emission driving patterns when a luminance distribution for pixel data of one display line falls under any of the patterns B–D in FIG. 4;

FIG. 29 is a diagram showing an example of a data conversion table used by the second data converter circuit 34 and light emission driving patterns when a luminance distribution for pixel data of one display line falls under the pattern A in FIG. 4, when the selective write address method is employed;

FIG. 30 is a diagram showing an example of a data conversion table used by the second data converter circuit 34 and light emission driving patterns when a luminance distribution for pixel data of one display line falls under any of the patterns B–D in FIG. 4, when the selective write address method is employed;

FIG. 32 is a diagram showing another example of a data conversion table used by the second data converter circuit 34 and light emission driving patterns when the selective write address method is employed; and FIG. 33 is a diagram showing another example of a data conversion table used by the second data converter circuit 34 and light emission driving patterns when the selective write address method is employed.

DETAILED DESCRIPTION OF THE EMBODIMENTS

In the following, embodiments of the present invention will be described with reference to the accompanying drawings.

Figure 1:
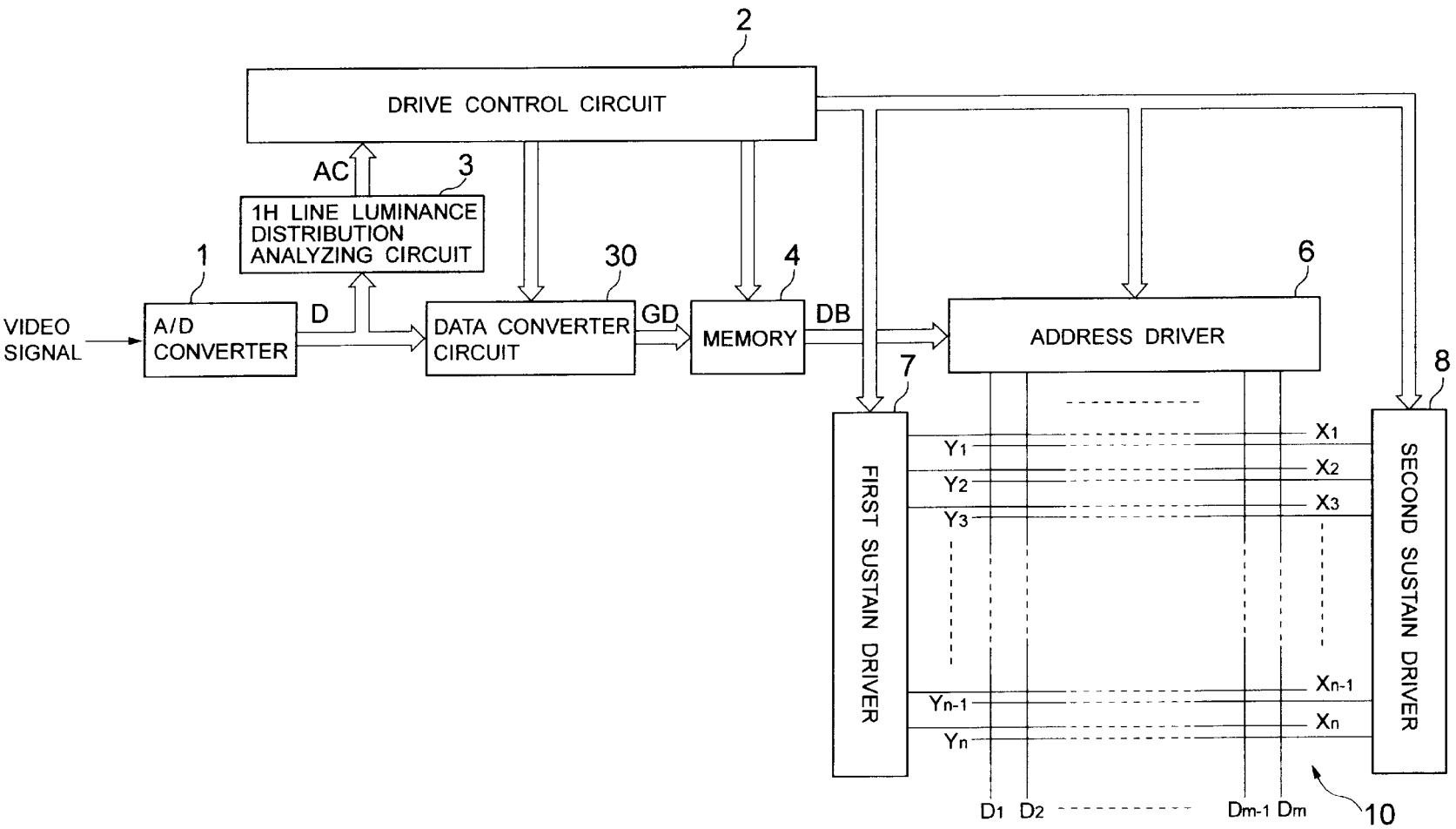
FIG. 1 is a block diagram illustrating the configuration of a plasma display device which drives a plasma display panel in gradation representation in accordance with a driving method according to the present invention.

FIG. 1 is a block diagram generally illustrating the configuration of a plasma display device which is equipped with a plasma display panel as the aforementioned display panel.

As illustrated in FIG. 1, the plasma display device comprises a PDP 10 as a plasma display panel and a driving unit for driving the plasma display panel based on a driving method according to the present invention.

The PDP 10 comprises m column electrodes $D_1$–$D_m$ as address electrodes, and n row electrodes $X_1$–$X_n$ and n row electrodes $Y_1$–$Y_n$ which are arranged to intersect these column electrodes. In the PDP 10, a pair of a row electrode X and a row electrode Y form a row electrode for displaying one display line on the PDP 10. The column electrode D and the row electrode pairs X, Y are covered with a dielectric layer defining a discharge space. A discharge cell corresponding to one pixel is formed at an intersection of each row electrode pair with each column electrode as a pixel cell. In other words, on one display line, m pixels are formed corresponding to m column electrodes, respectively.

An A/D converter 1 in the driving unit samples the input video signal for conversion to, for example, an 8-bit pixel data D. Then, the A/D converter 1 supplies the pixel data D to each of a 1H line luminance distribution analyzing circuit 3 and a data converter circuit 30.

The 1H line luminance distribution analyzing circuit 3, each time it is supplied with m pixel data D for one display line from the A/D converter 1, analyzes a luminance distribution on the one display line based on the m pixel data D. Then, the 1H line luminance distribution analyzing circuit 3 supplies accumulated frequency data AC to a drive control circuit 2 based on the result of the analysis.

Figure 2:
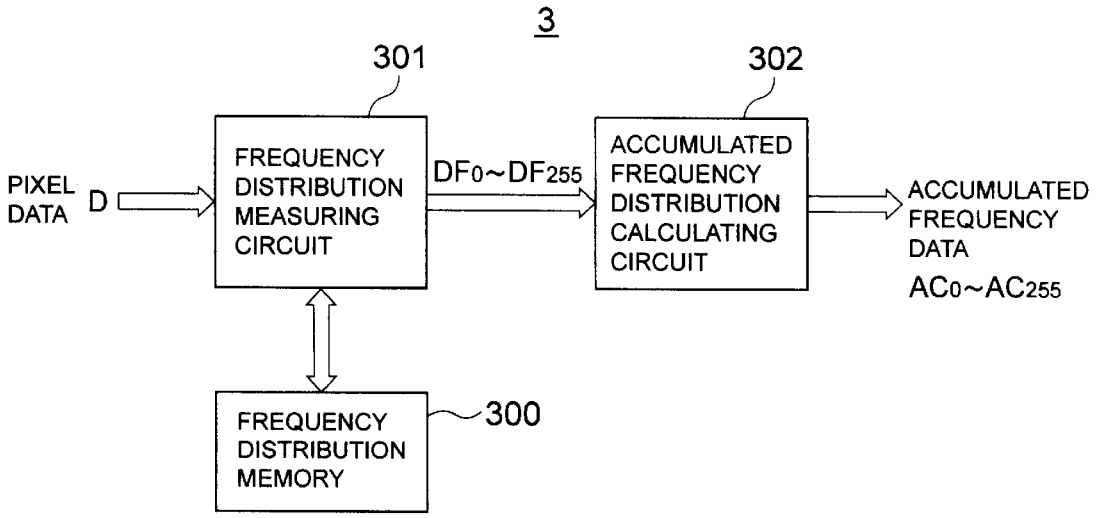
FIG. 2 is a block diagram illustrating the internal configuration of a 1H line luminance distribution analyzing circuit 3.

FIG. 2 is a block diagram illustrating an exemplary internal configuration of the 1H line luminance distribution analyzing circuit 3.

Figure 3:
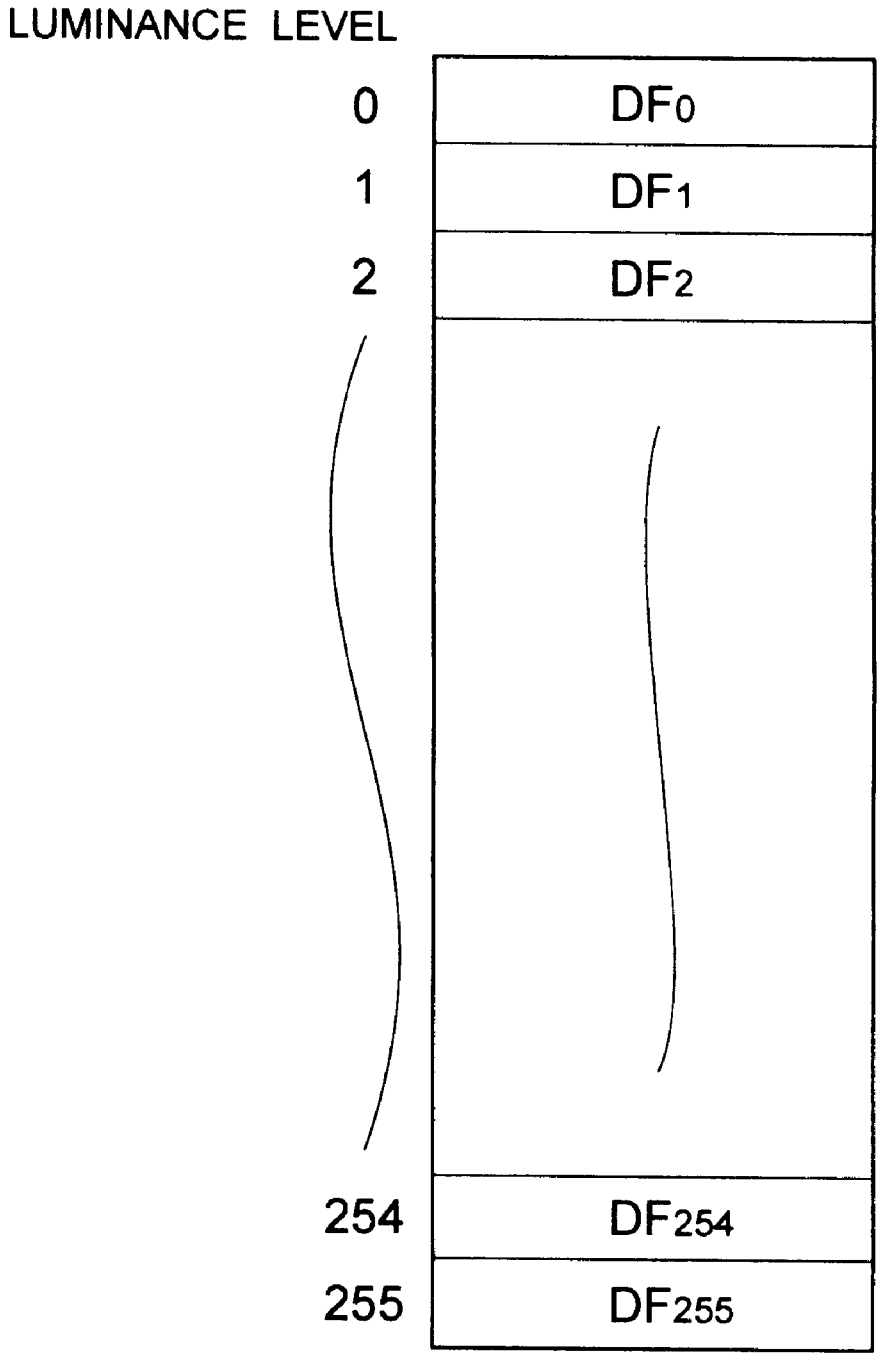
FIG. 3 is a diagram showing a memory map for a luminance distribution memory 300.

In FIG. 2, a frequency distribution memory 300 comprises 256 storage locations respectively corresponding to all possible luminance levels "0" to "255" represented by the pixel data D, as shown in FIG. 3. Each of the storage locations stores frequency data $DF_0$–$DF_{255}$ indicative of the number of times the pixel data having an associated luminance level has been supplied. Each of the frequency data $DF_0$–$DF_{255}$ has an initial value "0."

A frequency distribution measuring circuit 301, each time it is supplied with pixel data D for one pixel from the A/D converter 1, increments only the frequency data DF corresponding to a luminance level of the supplied pixel data D by one. Then, the frequency distribution measuring circuit 301 reads the frequency data $DF_0$–$DF_{225}$ from the frequency distribution memory 300 and supplies them to an accumulated frequency distribution calculating circuit 302 each time the foregoing processing has been completed for m pixel data D of one display line.

The accumulated frequency distribution calculating circuit 302 sequentially accumulates the frequency data $DF_0$–$DF_{255}$corresponding to one display line, starting with that corresponding to the lowest luminance level, and finds intermediate results at respective accumulating stages as accumulated frequency data $AC_0$–$AC_{255}$ respectively corresponding to the luminance levels "0" to "255."Specifically, the accumulated frequency distribution calculating circuit 302 finds the accumulated frequency data $AC_0$–$AC_{255}$ respectively corresponding to the luminance levels "0" to "255" by the following calculations.

Luminance Level "0": $AC_0=DF_0$

Luminance Level "1": $AC_1=DF_0+DF_1$

Luminance Level "2": $AC_2=DF_0+DF_1+DF_2$

•

•

•

Luminance Level "255": $AC_{255}=DF_0+DF_1+DF_2+DF_3+\ldots+DF_{255}$

In this event, since one display line is comprised of m pixel data D, a maximum value for the accumulated frequency data AC is "m." Then, the accumulated frequency distribution calculating circuit 302 supplies the accumulated frequency data $AC_0$–$AC_{255}$ to the drive control circuit 2.

Here, a luminance level corresponding to accumulated frequency data AC, the data value of which becomes larger than zero, is assigned as the lowest luminance level $B_{LO}$, and a luminance level corresponding to accumulated frequency data AC, the value of which becomes equal to "m," is assigned as the highest luminance level $B_{HI}$. Therefore, a range of $B_{LO}$ to $B_{HI}$ represents a luminance distribution of pixel data D in one display line as mentioned above. In the following, for simplicity, the following description will be made on a case where a luminance distribution represented by a range of the lowest luminance level $B_{LO}$ to the highest luminance level $B_{HI}$ in each display line of one field falls under, for example, any of four patterns A to D in FIG. 4. Specifically, the classification A in FIG. 4 corresponds to a luminance distribution extending over the full range of the luminance level from "0" to "255." The classification B in FIG. 4 corresponds to a luminance distribution extending in a low luminance range below a luminance level "128." The classification C in FIG. 4 corresponds to a luminance distribution extending in a middle luminance range from a luminance level "64" to "192." The classification D in FIG. 4 corresponds to a luminance distribution extending in a high luminance range above the luminance level "128."

In the following, the operation of the 1H line luminance distribution analyzing circuit 3 having the configuration as described above will be described for an example in which the luminance level of m pixel data D for one display line transitions as shown in FIGS. 5 to 8. FIGS. 5 to 8 each show an image, the luminance of which gradually transitions to higher luminance from a left end to a right end of a screen on one display line. In this event, FIG. 5 shows that the luminance level uniformly appears on one display line at all the luminance levels "0" to "255" which can be represented by 8-bit pixel data D. FIG. 6 shows that the luminance level uniformly appears on one display line in a range of luminance levels from "0" to "128." FIG. 7 shows that the luminance level uniformly appears on one display line in a range of luminance levels from "64" to "192." FIG. 8 shows that the luminance level uniformly appears on one display line in a range of luminance levels from "128" to "255."

Here, according to the pixel data D for one display line having the form as shown in FIG. 5, the frequency distribution of the respective luminance levels "0" to "255" is as shown in FIG. 9, and its accumulated frequency distribution is as shown in FIG. 13. Assuming herein that the luminance level "0" is allocated to the lowest luminance level $B_{LO}$; and the luminance level "255" to the highest luminance level $B_{HI}$, as shown in FIG. 13, the luminance distribution in the luminance range of "0" to "255" represented by these levels $B_{LO}$, $B_{HI}$ falls under the classification A in FIG. 4. Accordingly, the accumulated frequency data AC indicative of the classification A is supplied to the drive control circuit 2.

Also, according to the pixel data D for one display line having the form as shown in FIG. 6, the frequency distribution of the respective luminance levels "0" to "255" is as shown in FIG. 10, and its accumulated frequency distribution is as shown in FIG. 14. Assuming herein that the luminance level "0" is allocated to the lowest luminance level $B_{LO}$; and the luminance level "128" to the highest luminance level $B_{HI}$, as shown in FIG. 14, the luminance distribution in the luminance range of "0" to "128" represented by these levels $B_{LO}$, $B_{HI}$ falls under the classification B in FIG. 4. Accordingly, the accumulated frequency data AC indicative of the classification B is supplied to the drive control circuit 2.

Further, according to the pixel data D for one display line having the form as shown in FIG. 7, the frequency distribution of the respective luminance levels "0" to "255" is as shown in FIG. 11, and its accumulated frequency distribution is as shown in FIG. 15. Assuming herein that the luminance level "64" is allocated to the lowest luminance level $B_{LO}$; and the luminance level "192" to the highest luminance level $B_{HI}$, as shown in FIG. 15, the luminance distribution in the luminance range of "64" to "192" represented by these levels $B_{LO}$, $B_{HI}$, falls under the classification C in FIG. 4. Accordingly, the accumulated frequency data AC indicative of the classification C is supplied to the drive control circuit 2.

Further, according to the pixel data D for one display line having the form as shown in FIG. 8, the frequency distribution of the respective luminance levels "0" to "255" is as shown in FIG. 12, and its accumulated frequency distribution is as shown in FIG. 16. Assuming herein that the luminance level "128" is allocated to the lowest luminance level $B_{LO}$; and the luminance level "255" to the highest luminance level $B_{HI}$, as shown in FIG. 16, the luminance distribution in the luminance range of "128" to "255" represented by these levels $B_{LO}$, $B_{HI}$ falls under the classification D in FIG. 4. Accordingly, the accumulated frequency data AC indicative of the classification D is supplied to the drive control circuit 2.

In the manner described above, the 1H line luminance distribution analyzing circuit 3 sequentially analyzes the luminance distribution represented by pixel data D of input one display line, and supplies the accumulated frequency data AC in accordance with the luminance distribution to the drive control circuit 2.

The drive control circuit 2 fetches the accumulated frequency data AC in each display line of one field. Then, the drive control circuit 2 sets a driving sequence (light emission driving pattern) in each display line based on the accumulated frequency data AC in accordance with the ratio of the numbers of lines in respective luminance distribution patterns. Further, corresponding to the set driving sequence, the drive control circuit 2 further generates a conversion characteristic for a first data converter circuit 32 (a first data conversion table) and a conversion characteristic for a second data converter circuit 34 (a second data conversion table), later described, and sets the number of compressed bits in a multi-gradation processing circuit 33.

Figure 4:
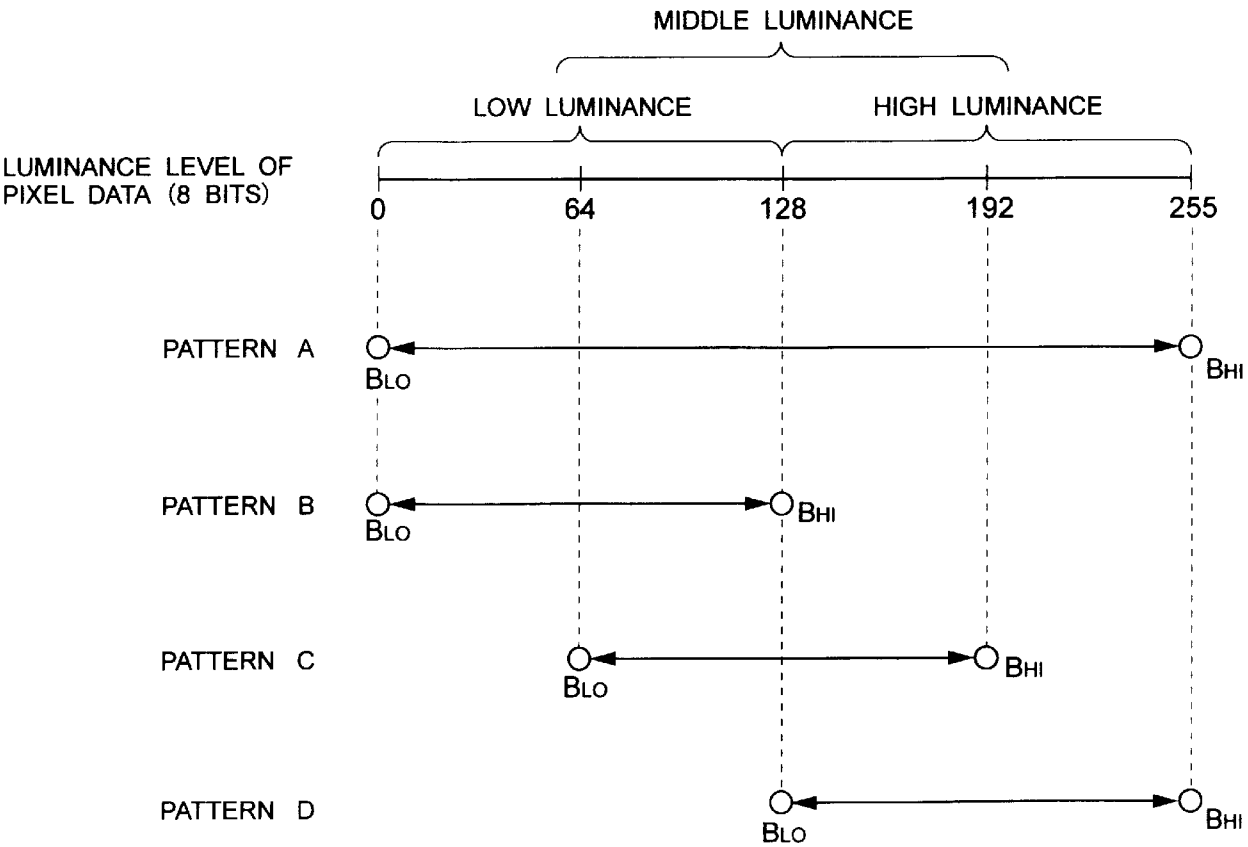
FIG. 4 is a diagram showing exemplary classification forms for a luminance distribution in a luminance distribution separating circuit 303.

For example, assuming that PDP driver is capable of displaying a gradation representation using seven subfields for one field display period, an average number of times of scanning per line (the number of times of write scanning) is seven. Then, on the basis of the seven subfields per line on average (an average number of times of scanning per line is seven), the aforementioned driving sequence (light emission driving pattern) and so on are set in accordance with the ratio of the numbers of lines in the respective luminance distribution patterns such that the basis is not exceeded. When the luminance distribution in each display line of an input video signal takes one of the four patterns as shown in FIG. 4 with a similar proportion, a display line which falls under the pattern A is set to a ten-subfield configuration, while a display line which falls under one of the patterns B, C, D is set to a five-subfield configuration.

Figure 17:
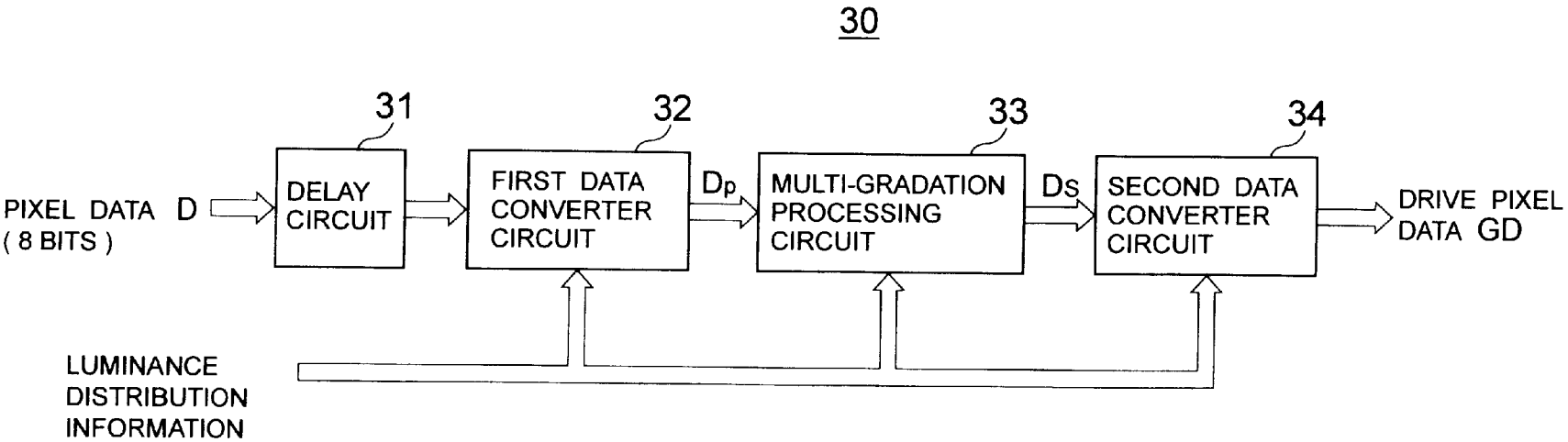
FIG. 17 is a block diagram illustrating the internal configuration of a data converter circuit 30.

FIG. 17 is a block diagram illustrating the internal configuration of the data converter circuit 30.

In FIG. 17, a delay circuit 31 delays pixel data D supplied from the A/D converter 1 by a predetermined time, and supplies the delayed pixel data D to a first data converter circuit 32.

It should be noted that the predetermined time is equal to a time spent for analyzing the luminance distribution of the pixel data for one display line in one field to set a driving sequence (light emission driving pattern) for each display line, and so on.

The first data converter circuit 32 converts the 8-bit pixel data D which can represent 256 gradational luminance levels from "0" to "255" to luminance limited pixel data $D_P$ which is limited in luminance to a range of "0" to "160," and supplies the luminance limited pixel data $D_P$ to a multi-gradation processing circuit 33.

Figure 18:
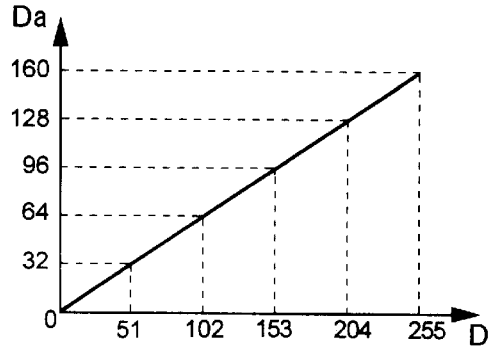
FIGS. 18 to 21 are graphs each showing a data conversion characteristic provided by the first data converter circuit 32.
Figure 19:
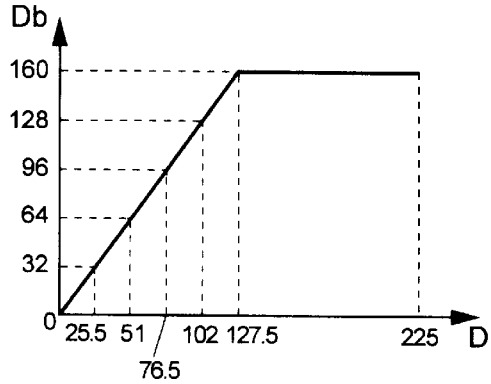
Figure 20:
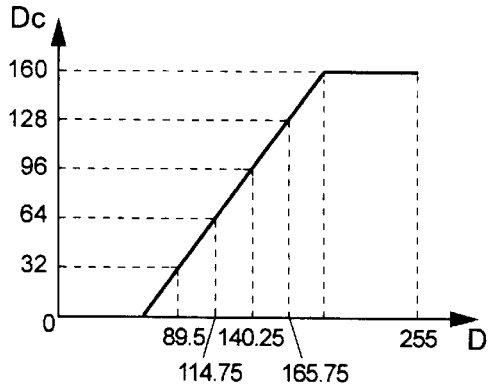
Figure 21:
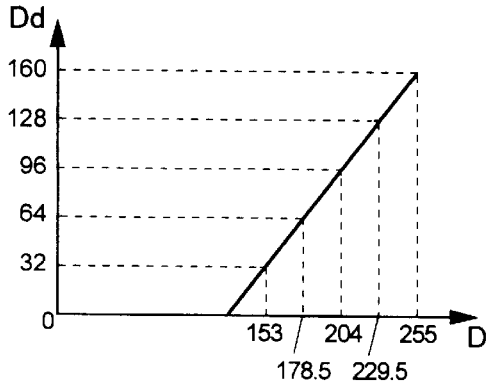

The first data converter circuit 32 is comprised, for example, of a rewritable memory. Stored contents in the memory (a conversion table, i.e., the conversion characteristic) is updated by a conversion table in accordance with a luminance distribution supplied from the drive control circuit 2, and set to a conversion characteristic (conversion table) in accordance with the luminance distribution represented by the input pixel data D of one display line. Specifically, when a luminance distribution for pixel data of one display line falls under the pattern A in FIG. 4, the conversion characteristic for the first data converter circuit 32 is set as shown in FIG. 18. In this event, the first data converter circuit 32 converts pixel data D of the display line to 8-bit luminance limited pixel data $D_P$ having a luminance range from level "0" to level "160" in accordance with a conversion characteristic as shown in FIG. 18, and supplies the pixel data $D_P$ to the multi-gradation processing circuit 33. When a luminance distribution for pixel data of one display line falls under the pattern B in FIG. 4, the conversion characteristic for the first data converter circuit 32 is set as shown in FIG. 19. In this event, the first data converter circuit 32 converts pixel data D of the display line to 8-bit luminance limited pixel data $D_P$ having a luminance range from level "0" to level "160" in accordance with a conversion characteristic as shown in FIG. 19, and supplies the pixel data $D_P$ to the multi-gradation processing circuit 33. When a luminance distribution for pixel data of one display line falls under the pattern C in FIG. 4, the conversion characteristic for the first data converter circuit 32 is set as shown in FIG. 20. In this event, the first data converter circuit 32 converts pixel data D of the display line to 8-bit luminance limited pixel data DP having a luminance range from level "0" to level "160" in accordance with a conversion characteristic as shown in FIG. 20, and supplies the pixel data $D_P$ to the multi-gradation processing circuit 33. When a luminance distribution for pixel data of one display line falls under the pattern D in FIG. 4, the conversion characteristic for the first data converter circuit 32 is set as shown in FIG. 21. In this event, the first data converter circuit 32 converts pixel data D of the display line to 8-bit luminance limited pixel data $D_P$ having a luminance range from level "0" to level "160" in accordance with a conversion characteristic as shown in FIG. 21, and supplies the pixel data $D_P$ to the multi-gradation processing circuit 33.

The multi-gradation processing circuit 33 applies multi-gradation processing such as error diffusion processing, dither processing and so on, which provides a bit compression in accordance with a luminance distribution, to the 8-bit luminance limited pixel data DP which has undergone the luminance limitation in the first data converter circuit 32, to generate multi-gradation pixel data $D_S$.

Specifically, when a luminance distribution for pixel data of one display line falls under the pattern A in FIG. 4, the multi-gradation processing circuit 33 compresses the 8-bit luminance limited pixel data $D_P$ on the display line by two bits with the error diffusion processing and by two bits with the dither processing. In this way, the multi-gradation processing circuit 33 produces 4-bit multi-gradation pixel data $D_S$. On the other hand, when a luminance distribution for pixel data of one display line falls under any of the patterns B–D in FIG. 4, the multi-gradation processing circuit 33 compresses the luminance limited pixel data $D_P$ by two bits with the error diffusion processing and by three bits with the dither processing. In this way, the multi-gradation processing circuit 33 produces 3-bit multi-gradation pixel data $D_S$. The 3-bit or 4-bit multi-gradation pixel data $D_S$ is supplied to the second data converter circuit 34.

The second data converter circuit 34 is comprised, for example, of a rewritable memory. Stored contents in the memory (a conversion table) is updated by a conversion table supplied from the drive control circuit 2, and set to a conversion table in accordance with the luminance distribution represented by the input pixel data D of one display line. Specifically, when a luminance distribution for pixel data of one display line falls under the pattern A in FIG. 4, the conversion table for the second data converter circuit 34 is set to a conversion table as shown in FIG. 22. In this event, the second data converter circuit 34 converts the 4-bit multi-gradation pixel data $D_S$ to 10-bit drive pixel data GD in accordance with the conversion table in FIG. 22, and supplies the drive pixel data GD to the memory 4. On the other hand, when a luminance distribution for pixel data of one display line falls under any of the patterns B–D in FIG. 4, the conversion table for the second data converter circuit 34 is set to a conversion table as shown in FIG. 23. The second data converter circuit 34 converts the 3-bit multi-gradation pixel data $D_S$ to 5-bit drive pixel data GD in accordance with the conversion table in FIG. 23, and supplies the drive pixel data GD to the memory 4.

The memory 4 sequentially stores the drive pixel data GD in response to a write signal supplied from the drive control circuit 2. As the drive pixel data $GD_{11}$–$GD_{nm}$ have been written into the memory 4 for one screen (n rows, m columns) on the PDP 10 by the write operation, the memory 4 performs a read operation as follows. It should be noted that in memory 4, each of the drive pixel data $GD_{11}$–$GD_{nm}$ is divided at each bit digit into groups of drive pixel data bits GDA-1, GDA-2, GDA-3, . . . , GDA-N (N is five or ten). In other words, only the first bits in the respective drive pixel data $GD_{11}$–$GD_{nm}$ are grouped into the group GDA-1; only the second bits into the group GDA-2; and so on. In this event, each drive pixel data bit group GDA is comprised of drive pixel data bits $DB_{11}$–$DB_{nm}$ of one screen (n rows, m columns). The memory 4 sequentially reads each of drive pixel data bits $DB_{11}$–$DB_{nm}$ in each drive pixel data bit group GDA every display line in the order of GDA-1, GDA-2, GDA-3, . . . , GDA-N, and supplies the read drive pixel data bits $DB_{11}$–$DB_{nm}$ to the address driver 6.

The drive control circuit 2 fetches the accumulated frequency data AC in each of display lines in one field, and sets a light emission driving format for each display line in accordance with the ratio of the numbers of lines in the respective luminance distribution patterns based on the accumulated frequency data AC. Then, the drive control circuit 2 supplies a variety of timing signals for driving the PDP 10 to each of the address driver 6, first sustain driver 7 and second sustain driver 8 in accordance with the thus set light emission driving format.

Figure 24:
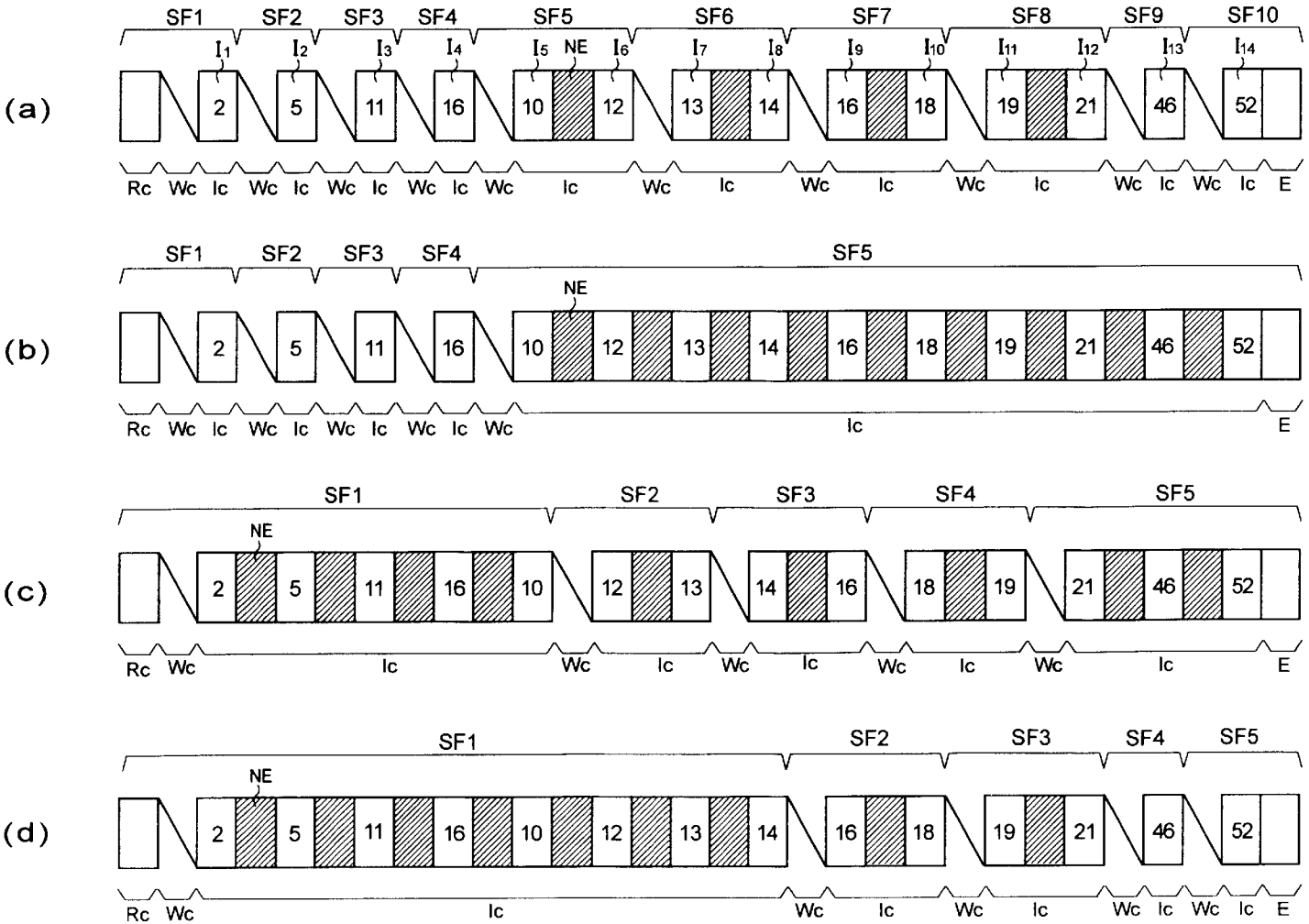
FIG. 24 includes diagrams each illustrating an example of light emission driving format based on a driving method according to the present invention.

As described above, when the luminance distribution in each display line of an input video signal takes one of the four patterns as shown in FIG. 4 with a similar proportion, the drive control circuit 2 sets a light emission driving format comprised of ten subfields as illustrated in a section (a) of FIG. 24 for a display line of pixel data, the luminance distribution of which falls under the pattern A in FIG. 4. The drive control circuit 2 sets a light emission driving format comprised of five subfields as illustrated in a section (b) of FIG. 24 for a display line of pixel data, the luminance distribution of which falls under the pattern B in FIG. 4. The drive control circuit 2 sets a light emission driving format comprised of five subfields as illustrated in a section (c) of FIG. 24 for a display line of pixel data, the luminance distribution of which falls under the pattern C in FIG. 4. The drive control circuit 2 sets a light emission driving format comprised of five subfields as illustrated in a section (d) of FIG. 24 for a display line of pixel data, the luminance distribution of which falls under the pattern D in FIG. 4.

In the driving formats illustrated in the sections (a)–(d) of FIG. 24, a simultaneous reset stage Rc for simultaneously initializing all discharge cells of the PDP 10 to either a "light emitting cell" or a "non-light emitting cell" is performed at the beginning of one field display period. Also, performed in each subfield is a pixel data writing stage Wc for conducting the scanning for writing the pixel data by sequentially setting each of discharge cells in one display line into a "light emitting cell" or a "non-light emitting cell" state in accordance with pixel data. Subsequently, 14 divisional light emission sustain stages $I_1$–$I_{14}$ are intermittently performed with the following light emission frequency ratio:

2:5:11:16:10:12:13:14:16:18:19:21:46:52

Here, when the light emission driving format illustrated in the section (a) of FIG. 24 is selected, the pixel data writing stage Wc is performed between the simultaneous reset stage Rc and the divisional light emission sustain stage $I_1$; between the divisional light emission sustain stages $I_1$ and $I_2$; between the divisional light emission sustain stages $I_2$ and $I_3$; between the divisional light emission sustain stages $I_3$ and $I_4$; between the divisional light emission sustain stages $I_4$ and $I_5$; between the divisional light emission sustain stages $I_6$ and $I_7$; between the divisional light emission sustain stages $I_8$ and $I_9$; between the divisional light emission sustain stages $I_{10}$ and $I_{11}$; between the divisional light emission sustain stages $I_{12}$ and $I_{13}$; and between the divisional light emission sustain stages $I_{13}$ and $I_{14}$ When the light emission driving format illustrated in the section (b) of FIG. 24 is selected, the pixel data writing stage Wc is performed between the simultaneous reset stage Rc and the divisional light emission sustain stage $I_1$; between the divisional light emission sustain stages $I_1$ and $I_2$; between the divisional light emission sustain stages $I_2$ and $I_3$; between the divisional light emission sustain stages $I_3$ and $I_4$; and between the divisional light emission sustain stages $I_4$ and $I_5$.

When the light emission driving format illustrated in the section (c) of FIG. 24 is selected, the pixel data writing stage Wc is performed between the simultaneous reset stage Rc and the divisional light emission sustain stage $I_1$; between the divisional light emission sustain stages $I_5$ and I6; between the divisional light emission sustain stages $I_7$ and $I_8$; between the divisional light emission sustain stages $I_9$ and $I_{10}$; and between the divisional light emission sustain stages $I_{11}$ and $I_{12}$.

When the light emission driving format illustrated in the section (d) of FIG. 24 is selected, the pixel data writing stage Wc is performed between the simultaneous reset stage Rc and the divisional light emission sustain stage $I_1$; between the divisional light emission sustain stages $I_8$ and $I_9$; between the divisional light emission sustain stages $I_{10}$ and $I_{11}$; between the divisional light emission sustain stages $I_{12}$ and $I_{13}$; and between the divisional light emission sustain stages $I_{13}$ and $I_{14}$.

In other words, between the simultaneous reset stage Rc and the divisional light emission sustain stage $I_1$, the scanning for writing the pixel data is performed by one display line at a time for all the display lines.

Between the divisional light emission sustain stages $I_1$ and $I_2$; between $I_2$ and $I_3$; $I_3$ and $I_4$; and $I_4$ and $I_5$, only for a discharge cells on a display line, the luminance distribution of which shows the pattern A or the pattern B in FIG. 4, the scanning for writing pixel data is performed as described above. In this event, a display line, the luminance distribution of which shows the pattern C or the pattern D in FIG. 4 is skipped without performing the scanning for writing pixel data.

Between the divisional light emission sustain stages $I_5$ and $I_6$ only for a discharge cells on a display line, the luminance distribution of which shows the pattern C in FIG. 4, the scanning for writing pixel data is performed as described above. In this event, display lines, the luminance distributions of which show the patterns A, B, D in FIG. 4 are skipped without performing the scanning for writing pixel data.

Between the divisional light emission sustain stages $I_6$ and $I_7$, only for a discharge cells on a display line, the luminance distribution of which shows the pattern A in FIG. 4, the scanning for writing pixel data is performed as described above. In this event, display lines, the luminance distributions of which show the patterns B, C, D in FIG. 4 are skipped without performing the scanning for writing pixel data.

Between the divisional light emission sustain stages $I_7$ and $I_8$, only for a discharge cells on a display line, the luminance distribution of which shows the pattern C in FIG. 4, the scanning for writing pixel data is performed as described above. In this event, display lines, the luminance distributions of which show the patterns A, B, D in FIG. 4 are skipped without performing the scanning for writing pixel data.

Between the divisional light emission sustain stages $I_8$ and $I_9$, only for a discharge cells on display lines, the luminance distributions of which show the patterns A, D in FIG. 4, the scanning for writing pixel data is performed as described above. In this event, display lines, the luminance distributions of which show the patterns B, C in FIG. 4 are skipped without performing the scanning for writing pixel data.

Between the divisional light emission sustain stages $I_9$ and $I_{10}$, only for a discharge cells on a display line, the luminance distribution of which shows the pattern C in FIG. 4, the scanning for writing pixel data is performed as described above. In this event, display lines, the luminance distributions of which show the patterns A, B, D in FIG. 4 are skipped without performing the scanning for writing pixel data.

Between the divisional light emission sustain stages $I_{10}$ and $I_{11}$, the luminance distributions of which show the patterns A, D in FIG. 4, the scanning for writing pixel data is performed as described above. In this event, display lines, the luminance distributions of which show the patterns B, C in FIG. 4 are skipped without performing the scanning for writing pixel data.

Between the divisional light emission sustain stages $I_{11}$ and $I_{12}$, only for a discharge cells on a display line, the luminance distribution of which shows the pattern C in FIG. 4, the scanning for writing pixel data is performed as described above. In this event, display lines, the luminance distributions of which show the patterns A, B, D in FIG. 4 are skipped without performing the scanning for writing pixel data.

Between the divisional light emission sustain stages $I_{12}$ and $I_{13}$, the luminance distributions of which show the patterns A, D in FIG. 4, the scanning for writing pixel data is performed as described above. In this event, display lines, the luminance distributions of which show the patterns B, C in FIG. 4 are skipped without performing the scanning for writing pixel data.

Between the divisional light emission sustain stages $I_{13}$ and $I_{14}$, the luminance distributions of which show the patterns A in FIG. 4, D, the scanning for writing pixel data is performed as described above. In this event, display lines, the luminance distributions of which show the patterns B, C in FIG. 4 are skipped without performing the scanning for writing pixel data.

It should be noted that between the divisional light emission sustain stages, there is provided a non-light emitting period NE, as indicated by hatchings in FIG. 24, in which the light emission state is stopped for a time equal to a time spent for the write scanning. Therefore, when the divisional light emission sustain stages, without the pixel data writing stage Wc interposed therebetween, are grouped into a single light emission sustain stage Ic, one field display period is comprised of ten subfields SF1–SF10 in the light emission driving format illustrated in the section (a) of FIG. 24. Therefore, a total number of times of write scanning for one display line is ten within one field display period. On the other hand, in the light emission driving formats illustrated in the sections (b)–(d) of FIG. 24, the one field display period is comprised of five subfields SF1–SF5. Therefore, a total number of times of write scanning for one display line is five within one field display period.

Each of the address driver 6, first sustain driver 7 and second sustain driver 8 applies a variety of driving pulses to each of column electrodes $D_1$–$D_m$ and row electrodes $X_1$–$X_n$ and $Y_1$–$Y_n$ for implementing the aforementioned operation in each of the simultaneous reset stage Rc, pixel data writing stage Wc, light emission sustain stage Ic and erasure stage E.

Figure 25:
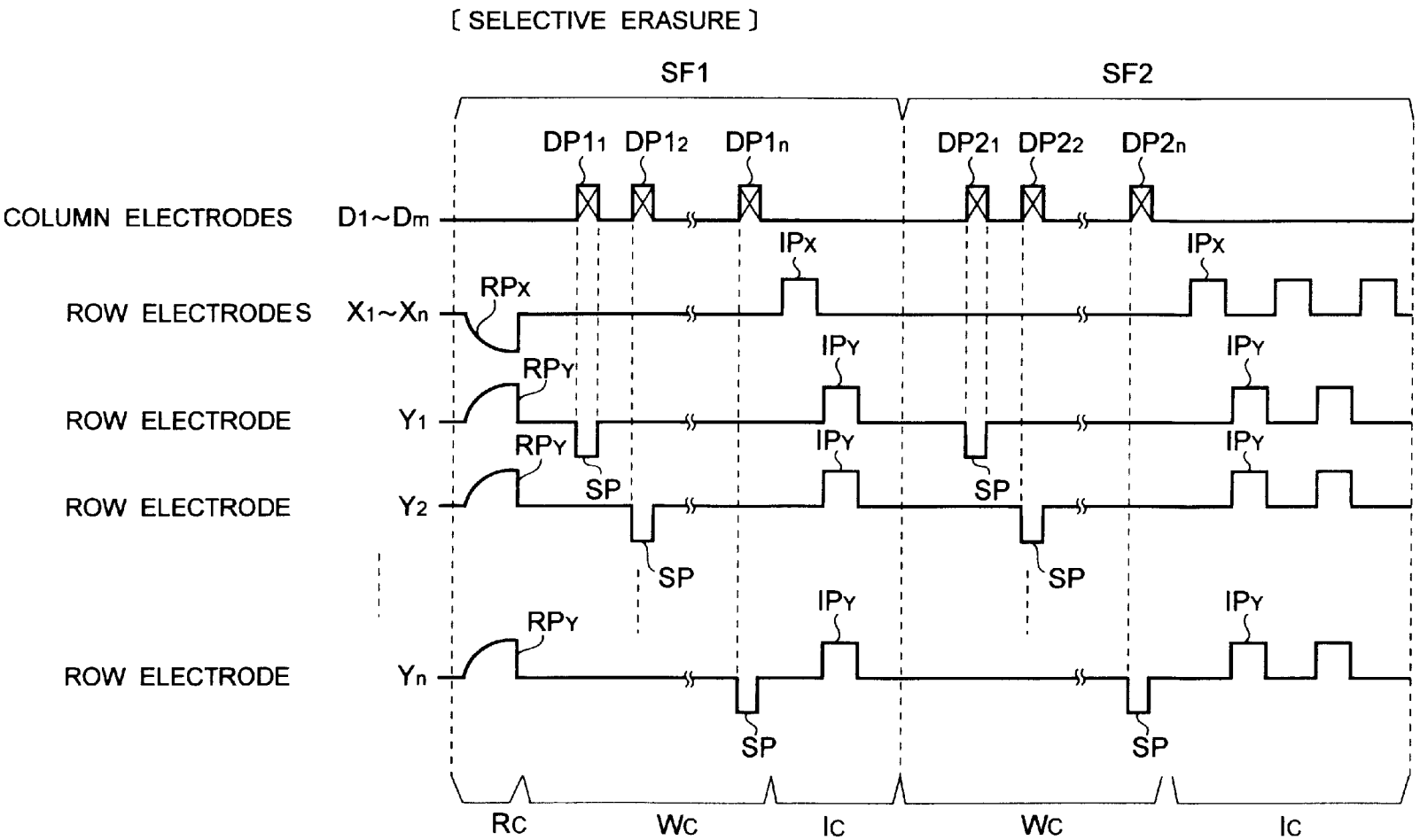
FIG. 25 is a waveform chart showing application timings at which a variety of driving pulse are applied for driving a PDP 10 to display in gradation representation in accordance with the light emission driving formats illustrated in FIG. 24.

FIG. 25 is a waveform chart showing exemplary timings at which such driving pulses are applied.

It should be noted that FIG. 25 only shows application timings of driving pulses in each of the first subfields SF1, SF2 at the beginning of the light emission driving format illustrated in the section (a) of FIG. 24.

First, in the simultaneous reset stage Rc, the first sustain driver 7 generates the reset pulse $RP_X$ of negative polarity, while the second sustain driver 8 generates the reset pulse $RP_Y$ of positive polarity. These reset pulses are simultaneously applied to the row electrodes $X_1$–$X_n$ and $Y_1$–$Y_n$, respectively. The application of these reset pulses $RP_X$, $RP_Y$ causes all the discharge cells in the PDP 10 to be reset or discharged to forcedly form a uniform wall charge in each of the discharge cells. In other words, all the discharge cells in the PDP 10 are once initialized to "light emitting cells."

Next, in the pixel data writing stage Wc, the address driver 6 generates a pixel data pulse having a voltage corresponding to a logical level of the drive pixel data bit DB supplied from the memory 4, and supplies the pixel data pulses for each display line to the column electrodes $D_1$–$D_m$. For example, in the subfield SF1, data corresponding to the first line, i.e., drive pixel data bits $DB_{11}$, $DB_{12}$, $DB_{13}$, . . . , $DB_{1m}$ are extracted from the drive pixel data bit group GDA-1. Then, a pixel data pulse group $DP1_1$ comprised of m pixel data pulses corresponding to logical levels of the respective drive pixel data bits DB is generated and applied to the column electrodes $D_1$–$D_m$. Next, data corresponding to the second line, i.e., drive pixel data bits $DB_{11}$, $DB_{12}$, $DB_{13}$, . . . , $DB_{1m}$ are extracted from the drive pixel data bit group GDA-1. Then, a pixel data pulse group $DP1_2$ comprised of m pixel data pulses corresponding to logical levels of the respective drive pixel data bits DB is generated and applied to the column electrodes $D_1$-$D_m$. Subsequently, in a similar manner, pixel data pulse groups $DP_{13}$–$DP1_n$ for each display line are sequentially applied to the column electrodes $D_1$–$D_m$. Likewise, in the subfield SF2, data corresponding to the first line, i.e., drive pixel data bits $DB_{11}$, $DB_{12}$, $DB_{13}$, . . . , $DB_{1m}$ are extracted from the drive pixel data bit group GDA-2. Then, a pixel data pulse group $DP2_1$ comprised of m pixel data pulses corresponding to logical levels of the respective drive pixel data bits DB is generated and applied to a column electrodes $D_1$–$D_m$. Next, data corresponding to the second line, i.e., drive pixel data bits $DB_{11}$, $DB_{12}$, $DB_{13}$, . . . , $DB_{1m}$ are extracted from the drive pixel data bit group GDA-2. Then, a pixel data pulse group $DP2_2$ comprised of m pixel data pulses corresponding to logical levels of the respective drive pixel data bits DB is generated and applied to a column electrode $D_1$–$D_m$. Subsequently, in a similar manner, pixel data pulse groups $DP2_3$–$DP2_n$ for each display line are sequentially applied to the column electrodes $D_1$–$D_m$.

Assume herein that the address driver 6 generates a pixel data pulse at a high voltage when drive pixel data bit DB is at logical level "1" and generates a pixel data pulse at a low voltage (zero volt) when drive pixel data bit DB is at logical level "0."

Further, in the pixel data writing stage Wc, the second sustain driver 8 sequentially applies a scanning pulse SP of negative polarity to the row electrodes $Y_1$–$Y_n$ at the same timing at which each pixel data pulse group DP is applied, as shown in FIG. 25. In this event, the discharge (selective writing discharge) occurs only in discharge cells at intersections of "rows" applied with the scanning pulse SP with "columns" applied with the pixel data pulse at the high voltage to selectively extinguish the wall charges which have remained in the discharge cells. This selective writing discharge as described causes the discharge cells initialized to the "light emitting cell" state in the simultaneous reset stage Rc to transition to the "non-light emitting cells." On the other hand, the selective writing discharge as described above does not occur in discharge cells formed in a column which have not been applied with the pixel data pulse at the high voltage, so that these discharge cells are maintained in the initialized state in the simultaneous reset stage Rc, i.e., the "light emitting cell" state. In other words, the pixel data writing stage Wc performed in each subfield causes each of the discharge cells to be set to a "light emitting cell" in which the sustain discharge is produced in the subsequent light emission sustain stage Ic or a "non-light emitting cell" in which no sustain discharge is produced.

Next, in the light emission sustain stage Ic, the first sustain driver 7 and the second sustain driver 8 alternately apply the sustain pulses $IP_X$, $IP_Y$ of positive polarity to the row electrodes $X_1$–$X_n$ and $Y_1$–$Y_n$, as illustrated in FIG. 25. It should be noted that the first and second sustain drivers 7, 8 stop applying the sustain pulses $IP_X$, $IP_Y$ in the non-light emitting period NE, and resume alternately applying the sustain pulses $IP_X$, $IP_Y$ after the non-light emitting period NE. In this event, in the discharge cells in which the wall charges remain in the pixel data writing stage Wc, i.e., in the "light emitting cells," the sustain discharge is produced each time they are applied with the sustain pulses $IP_X$, $IP_Y$. In other words, while the sustain discharge is intermittently produced, a light emitting state associated with the sustain discharge is sustained.

The pixel data writing stage Wc and light emission sustain stage Ic as described above are performed as well in the remaining subfields.

Here, when the luminance distribution for pixel data of one display line falls under the pattern A in FIG. 4, i.e., when the luminance level on the one display line uniformly distributes over the entire luminance range from luminance level "$_0$" to "$_{255}$," the drive control circuit 2 performs gradation driving in accordance with the light emission driving format illustrated in the section (a) of FIG. 24. Accordingly, each of the first sustain driver 7 and the second sustain driver 8 applies the sustain pulse IP to the PDP 10 the following number of times in the light emission sustain stage Ic in each of the ten subfields SF1–SF10 illustrated in the section (a) of FIG. 24:

SF1: 2 (the number of light emissions in the divisional light emission sustain stage $I_1$);

SF2: 5 (the number of light emissions in the divisional light emission sustain stages $I_2$);

SF3: 11 (the number of light emissions in the divisional light emission sustain stage $I_3$);

SF4: 16 (the number of light emissions in the divisional light emission sustain stage $I_4$);

SF5: 22 (the total number of light emissions in the divisional light emission sustain stages $I_5$–$I_6$);

SF6: 27 (the total number of light emissions in the divisional light emission sustain stages $I_7$–$I_8$);

SF7: 34 (the total number of light emissions in the divisional light emission sustain stages $I_9$–$I_{10}$);

SF8: 40 (the total number of light emissions in the divisional light emission sustain stages $I_{11}$–$I_{12}$);

SF9: 46 (the number of light emissions in the divisional light emission sustain stage $I_{13}$); and SF10: 52 (the number of light emissions in the divisional light emission sustain stage $I_{14}$).

When the luminance distribution for pixel data of one display line falls under the pattern B in FIG. 4, i.e., when the luminance level on the one display line partially distributes in the low luminance range, the drive control circuit 2 performs gradation driving for this display line in accordance with the light emission driving format illustrated in the section (b) of FIG. 24. Accordingly, each of the first sustain driver 7 and the second sustain driver 8 applies the sustain pulse IP to the PDP 10 the following number of times in the light emission sustain stage Ic in each of the five subfields SF1–SF5 illustrated in the section (b) of FIG. 24:

SF1: 2 (the number of light emissions in the divisional light emission sustain stage $I_1$);

SF2: 5 (the number of light emissions in the divisional light emission sustain stage $I_2$);

SF3: 11 (the number of light emissions in the divisional light emission sustain stage $I_3$);

SF4: 16 (the number of light emissions in the divisional light emission sustain stage $I_4$); and SF5: 221 (the total number of light emission in the divisional light emission sustain stages $I_5$–$I_{14}$).

When the luminance distribution for pixel data of one display line falls under the pattern C in FIG. 4, i.e., when the luminance level on the one display line partially distributes in the middle luminance range, the drive control circuit 2 performs gradation driving for this display line in accordance with the light emission driving format illustrated in the section (c) of FIG. 24. Accordingly, each of the first sustain driver 7 and the second sustain driver 8 applies the sustain pulse IP to the PDP 10 the following number of times in the light emission sustain stage Ic in each of the five subfields SF1–SF5 illustrated in the section (c) of FIG. 24:

SF1: 44 (the total number of light emissions in the divisional light emission sustain stages $I_1$–$I_5$);

SF2: 25 (the total number of light emissions in the divisional light emission sustain stage $I_6$–$I_7$);

SF3: 30 (the total number of light emissions in the divisional light emission sustain stages $I_8$–$I_9$);

SF4: 37 (the total number of light emissions in the divisional light emission sustain stages $I_{10}$–$I_{11}$); and SF5: 119 (the total number of light emissions in the divisional light emission sustain stages $I_{12}$–$I_{14}$).

When the luminance distribution for pixel data of one display line falls under the pattern D in FIG. 4, i.e., when the luminance level on the one display line partially distributes in the high luminance range, the drive control circuit 2 performs gradation driving for this display line in accordance with the light emission driving format illustrated in the section (d) of FIG. 24. Accordingly, each of the first sustain driver 7 and the second sustain driver 8 applies the sustain pulse IP to the PDP 10 the following number of times in the light emission sustain stage Ic in each of the five subfields SF1–SF5 illustrated in the section (d) of FIG. 24:

SF1: 83 (the total number of light emissions in the divisional light emission sustain stages $I_1$–$I_8$);

SF2: 34 (the total number of light emissions in the divisional light emission sustain stages $I_9$–$I_{10}$);

SF3: 40 (the total number of light emissions in the divisional light emission sustain stages $I_{11}$–$I_{12}$);

SF4: 46 (the number of light emissions in the divisional light emission sustain stage $I_{13}$); and SF5: 52 (the total number of light emissions in the divisional light emission sustain stage $I_{14}$).

In this way, a display at a luminance in accordance with the total number of times of sustain discharges produced in the light emission sustain stage Ic in each of the subfields SF appears on the screen of the PDP 10. It should be noted that whether or not the sustain discharge as described above is produced in the light emission sustain stage Ic in each subfield is determined depending on whether or not the selective erasure discharge is produced in the pixel data writing stage Wc in the subfield. According to drive pixel data GD in FIGS. 22 and 23, the selective erasure discharge is produced in the pixel data writing stage Wc only in one of the subfields SF within one field, as indicated by black circles. Therefore, the wall charges formed in the simultaneous reset stage Rc in the first subfield SF1 remain until the selective erasure discharge occurs, thereby allowing each of the discharge cells to sustain the "light emitting cell" state. In other words, the sustain discharge, causing light emission, is produced in the light emission sustain stage Ic in each of the subfields (indicated by white circles) intervening therebetween. Here, the drive pixel data GD has 11 possible patterns as shown in FIG. 22 when the luminance distribution for one display line of pixel data falls under the pattern A in FIG. 4, i.e., the luminance level on one display line uniformly distributes over the entire luminance range. On the other hand, when the luminance distribution for one display line of pixel data falls under any pattern other than the pattern A, i.e., when the luminance level on one display line partially distributes in a certain luminance range, the drive pixel data GD has six possible patterns as shown in FIG. 23.

Therefore, when the luminance level on one display line uniformly distributes over the entire luminance range, the driving sequence based on the light emission driving format in the section (a) of FIG. 24 is performed for this display line, so that the following 11 intermediate display luminance levels are provided according to the ten light emission driving patterns shown in FIG. 22:

{0, 2, 7, 18, 34, 56, 83, 117, 157, 203, 255}

In other words, the gradation driving is performed at the eleven gradation levels, intended for the entire luminance range from "0" to "255."

On the other hand, when the luminance level on one display line partially distributes in the low luminance range, the driving sequence based on the light emission driving format in the section (b) of FIG. 24 is performed for this display line, so that the following six intermediate display luminance levels are provided according to the six light emission driving patterns shown in FIG. 23:

{0, 2, 7, 28, 34, 255}

In other words, the gradation driving is performed at the six gradation levels, intended only for the low luminance range from "0" to "128."

Also, when the luminance level on one display line partially distributes in the middle luminance range, the driving sequence based on the light emission driving format in the section (c) of FIG. 24 is performed for this display line, so that the following six intermediate display luminance levels are provided according to the six light emission driving patterns shown in FIG. 23:

{0, 44, 69, 99, 136, 255}

In other words, the gradation driving is performed at the six gradation levels, intended only for the middle luminance range from "64" to "192."

Finally, when the luminance level on one display line partially distributes in the high luminance range, the driving sequence based on the light emission driving format in the section (d) of FIG. 24 is performed for this display line, so that the following six intermediate display luminance levels are provided according to the six light emission driving patterns shown in FIG. 23:

{0, 83, 117, 157, 203, 255}

In other words, the gradation driving is performed at the six gradation levels, intended only for the high luminance range from "128" to "255."

It should be noted that luminance levels other than the foregoing ten or six intermediate luminance levels are virtually provided by the aforementioned multi-gradation processing circuit 33.

In the foregoing embodiment, the ratio of the numbers of lines in the respective luminance distribution patterns is calculated based on the accumulated frequency data AC on each display line in one field, and a light emission driving format is set in each display line in accordance with the ratio. Then, based on the light emission driving format, a conversion characteristic (first data conversion table) for the first data converter circuit 32 and a conversion characteristic (second data conversion table) for the second data converter circuit 34 are generated to set the number of compressed bits in the multi-gradation processing circuit 33.

For example, the capability of a PDP driver permits division of one field display period into seven subfields to provide a gradation representation, the number of subfields is changed on the basis of seven subfields per line on average (an average number of times of scanning per line is seven). For example, when the luminance level for one display line of an input video signal uniformly distributes over the entire luminance range, ten subfields, more than the average number of subfields, are allocated to the display line for gradation driving to improve the gradation representation. On the other hand, when the luminance level for one display line of an input video signal partially distributes in any of the high, middle and low luminance ranges, five subfields, less than the average number of subfields, are allocated to the display line for gradation driving at six levels. In this event, when the luminance level for one display line of an input video signal concentrates in a relatively narrow range, a reduction in the number of subfields allocated to the display line would not cause a degraded gradation representation.

As described above, in the present invention, the number of subfields in one field display period is changed every display line in accordance with the luminance distribution in one display line of an input video signal. It is therefore possible to perform an optimal gradation display for each display line in accordance with the contents of an image represented by the input video signal.

While in the foregoing embodiment, the luminance distribution in one field of display line takes any of the four patterns A–D in FIG. 4, actual video signals will present an infinite number of luminance distribution patterns. Therefore, the ratio of the numbers of lines in these patterns is calculated to set a light emission driving format (the number of divided subfields) in each display line in accordance with the ratio such that a total time required for the pixel data writing stages in one field display period remains constant.

Also, while the foregoing embodiment measures the luminance distribution of an input video signal every display line to change the number of subfields in one field display period every display line, this operation may be performed every group of a plurality of display lines. Specifically, the luminance distribution of an input video signal may be measured in units of a plurality of display lines to change the number of subfields in one field display period every group of the plurality of display lines.

Alternatively, the luminance distribution of an input video signal may be measured in units of a plurality of display lines to change the number of subfields in accordance with the luminance distribution in one field display period every display line.

Also, in the foregoing embodiment, the selective erasure discharge is produced only in the pixel data writing stage Wc of any of the subfields as shown in FIGS. 22 and 23. However, if a small amount of charged particles remains in a discharge cell, the selective erasure discharge may not be successfully produced, thereby failing to normally write pixel data. To solve this problem, a conversion table for the second data converter circuit 34 and light emission driving patterns shown in FIG. 26 are employed in place of those shown in FIG. 22. Further, a conversion table for the second data converter circuit 34 and light emission driving patterns shown in FIG. 27 are employed in place of those shown in FIG. 23. According to the light emission driving patterns shown in FIGS. 26 and 27, the same selective erasure discharge is performed for each discharge cell a plurality of times in succession, so that the selective erasure discharges are produced without fail, and therefore pixel data is correctly written.

The foregoing embodiment has been described for the so-called selective erasure address method, employed as a method of writing pixel data, wherein a wall charge is previously formed in each discharge cell, and the wall discharge is selectively erased in accordance with pixel data to write the pixel data.

The present invention, however, can be applied as well to a so-called selective write address method, employed as the method of writing pixel data, wherein wall charges are selectively formed in accordance with pixel data.

Figure 28:
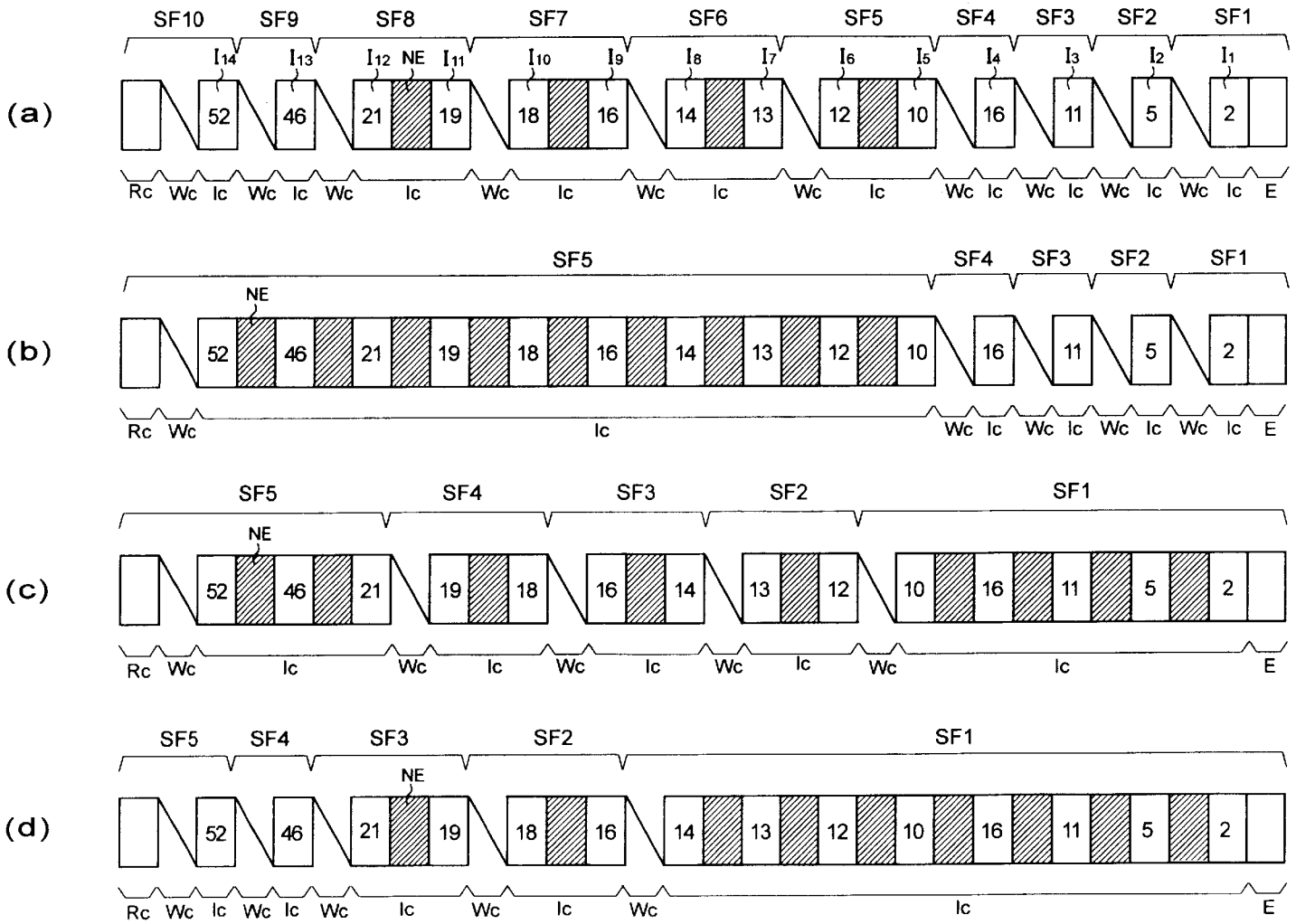
FIG. 28 includes diagrams each illustrating a light emission driving format used when a selective write address method is employed.

Sections (a)–(d) of FIG. 28 are diagrams illustrating light emission driving formats for use in driving the PDP 10 in gradation representation, employing the selective write address method. FIGS. 29 and 30 are diagrams showing conversion tables used in the second data converter circuit 34 and light emission driving patterns when the selective write address method is employed. FIG. 29 is a diagram showing a conversion table used in the second data converter circuit 34 and light emission driving patterns when those shown in FIG. 22 are applied to the selective write address method. FIG. 30 is a diagram showing a conversion table used in the second data converter circuit 34 and light emission driving patterns when those shown in FIG. 23 are applied to the selective write address method.

When the selective write address method is employed, the order of the subfields SF are reversed to that when the selective erasure address method is employed, as illustrated in the sections (a)–(d) of FIG. 28. Specifically, the subfield SF10 (or SF5) is used as the first subfield, while the subfield SF1 is used as the last subfield. The formats illustrated in the sections (a)–(d) of FIG. 28 are similar to the format illustrated in the sections (a)–(d) of FIG. 24, used when the selective erasure address method is employed, in that the pixel data writing stage Wc and the light emission sustain stage Ic are performed in each subfield but the simultaneous reset stage Rc is performed only in the first subfield.

For performing the gradation driving in accordance with the selective write address method, the drive control circuit 2 sets a light emission driving format in each display line in accordance with the ratio of the numbers of lines in the respective luminance distribution patterns.

For example, when the luminance distribution in each display line of an input video signal takes one of the four patterns as shown in FIG. 4 with a similar proportion, the drive control circuit 2 sets a light emission driving format in the following manner. Specifically, the drive control circuit 2 sets a light emission driving format comprised of ten subfields as illustrated in a section (a) of FIG. 28 for a display line of pixel data, the luminance distribution of which falls under the pattern A in FIG. 4. The drive control circuit 2 sets a light emission driving format comprised of five subfields as illustrated in a section (b) of FIG. 28 for a display line of pixel data, the luminance distribution of which falls under the pattern B in FIG. 4. The drive control circuit 2 sets a light emission driving format comprised of five subfields as illustrated in a section (c) of FIG. 28 for a display line of pixel data, the luminance distribution of which falls under the pattern C in FIG. 4. The drive control circuit 2 sets a light emission driving format comprised of five subfields as illustrated in a section (d) of FIG. 28 for a display line of pixel data, the luminance distribution of which falls under the pattern D in FIG. 4.

Then, the drive control circuit 2 supplies each of the address driver 6, first sustain driver 7 and the second sustain driver 8 with a variety of timing signals for driving the PDP 10 in gradation representation in accordance with the selected light emission driving format.

Figure 31:
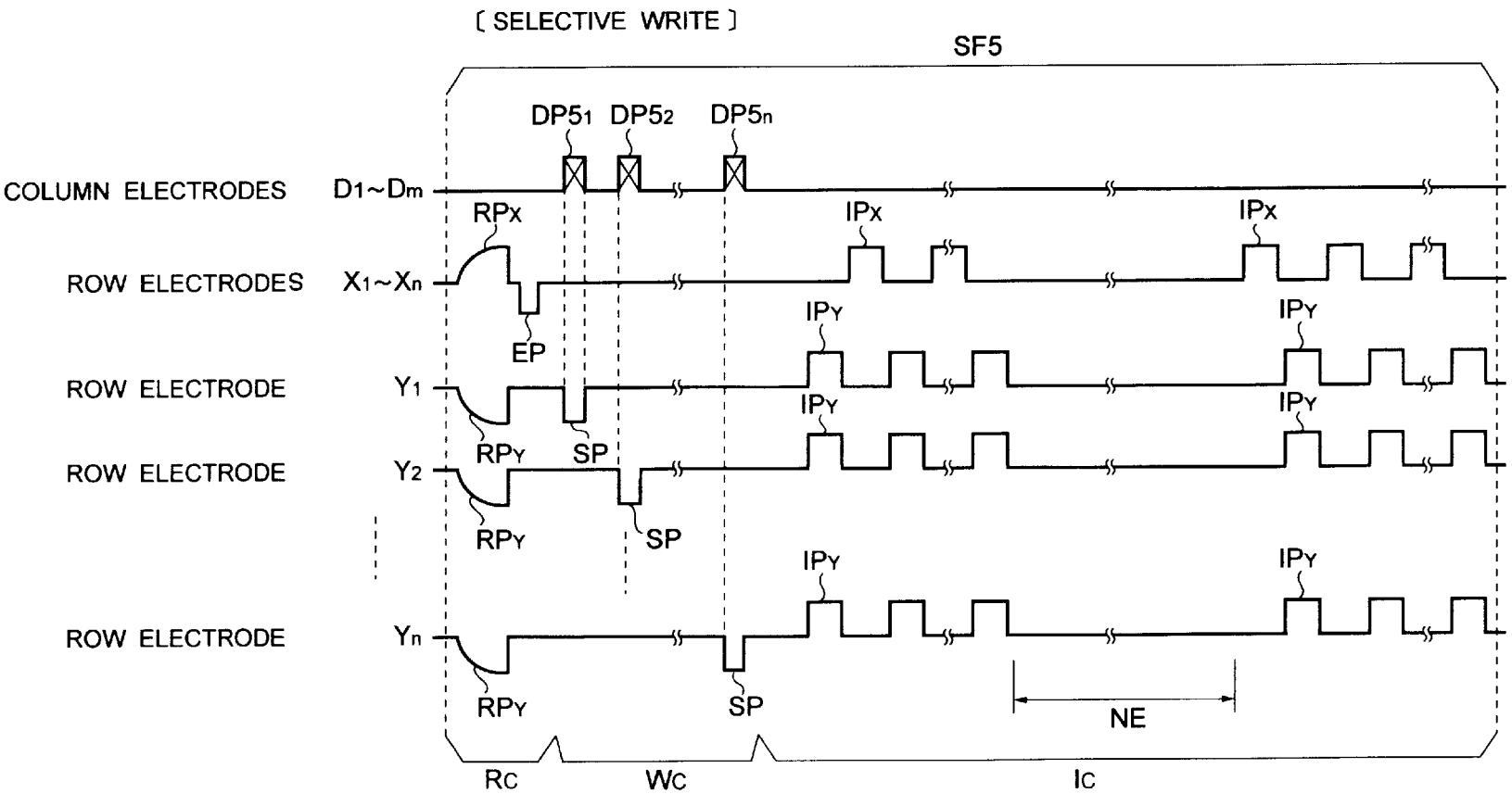
FIG. 31 is a waveform chart showing application timings at which a variety of driving pulses are applied when the PDP 10 is driven to display in gradation representation in accordance with the light emission driving formats illustrated in FIG. 28.

FIG. 31 is a waveform chart showing application timings at which each of the address driver 6, first sustain driver 7 and the second sustain driver 8 applies the PDP 10 with a variety of driving pulses when the selective write address method is employed.

It should be noted that FIG. 33 only shows application timings in the first subfield SF5 extracted from the light emission driving format illustrated in the section (a) of FIG. 28.

In FIG. 31, in the simultaneous reset stage Rc, immediately after the first sustain driver 7 and the second sustain driver 8 generate the reset pulse $RP_X$ and pulse $RP_Y$ to the row electrodes X and Y of the PDP 10, respectively, the first sustain driver 7 simultaneously applies an erasure pulse EP to the row electrodes $X_1$–$X_n$. The application of the erasure pulse causes an erasure discharge to be produced and extinguish wall charges formed in all the discharge cells. In other words, in the simultaneous reset stage Rc when the selective write address method is employed as shown in FIG. 28, all the discharge cells in the PDP 10 are initialized to "non-light emitting cells." In the pixel data writing stage Wc, as is the case when the selective erasure address method is employed, the address driver 6 generates a pixel data pulse group DP of one row having voltages corresponding to logical levels of drive pixel data bits DB, and sequentially applies the pixel data pulses row by row to the column electrodes $D_1$–$D_m$. Further, in the pixel data writing stage Wc, the second sustain driver 8 generates a scanning pulse SP of negative polarity at the same timing at which each pixel data pulse group DP is applied, and sequentially applies the scanning pulse SP to the row electrodes $Y_1$–$Y_n$. In this event, the discharge (selective write discharge) occurs only in discharge cells at intersections of "rows" applied with the scanning pulse SP with "columns" applied with the pixel data pulse at the high voltage to form wall charges in the discharge cells. Specifically, the selective write discharge is produced only in the pixel data writing stage Wc in those subfields which correspond to bit digits at logical level "1" in the drive pixel data GD as shown in FIGS. 29 and 30. The selective write discharge causes the discharge cells initialized to the "non-light emitting cell" state in the simultaneous reset stage Rc to transition to a "light emitting cell" state. On the other hand, the discharge does not occur in discharge cells formed in "columns" which have not been applied with the pixel data pulse at the high voltage, so that these discharge cells are maintained in the initialized state in the simultaneous reset stage Rc, i.e., the "non-light emitting cell" state.

Next, in the light emission sustain stage Ic, the first sustain driver 7 and the second sustain driver 8 alternately apply the sustain pulses $IP_X$, $IP_Y$ of positive polarity to the row electrodes $X_1$–$X_n$ and $Y_1$–$Y_n$, as illustrated in FIG. 31. The application of the sustain pulses IP causes only the discharge cells in which the wall charges have been formed in the pixel data writing stage Wc, i.e., the "light emitting cells" to discharge for sustaining the light emission each time they are applied with the sustain pulses $IP_X$, $IP_Y$. In this event, according to the drive pixel data bits GD shown in FIGS. 29 and 30, the light emission is sustained the number of times (period) described in the sections (a)–(d) of FIG. 28 in the light emission sustain stage Ic in each of subfields in which the selective write discharges have been performed (indicated by black circles) and subfields subsequent thereto (indicated by white circles).

Also, when the selective write address method as described above is employed, the same selective erasure discharge is also performed for each discharge cell a plurality of times in succession to improve the accuracy at which pixel data is written, as is the case when the selective erasure address method is employed.

FIGS. 32 and 33 are diagrams showing conversion tables used by the second data converter circuit 34 and light emission driving patterns when the same selective write discharge is performed for each discharge cell twice in succession.

As described above in detail, in the present invention, the luminance distribution of an input video signal is measured every display line (or every plurality of display lines), and the number subfields in one field display period is changed every display line (or every plurality of display lines) in accordance with the luminance distribution. With this sequence of operation, it is possible to perform an optimal gradation display in accordance with a pattern represented by an input video signal.

What is claimed is:

1. A display panel driving method for driving a display panel having a plurality of pixel cells arranged in matrix in accordance with a video signal, said method comprising:

performing, in each of a plurality of divisional display periods constituting a unit display period in said video signal, a pixel data writing stage for setting each of said pixel cells to either a light emitting cell or a non-light emitting cell in accordance with pixel data corresponding to said video signal, and a light emission sustain stage for causing only said light emitting cells to emit light a number of light emissions allocated thereto corresponding to a weighting factor applied to each of said divisional display periods;

obtaining a luminance distribution of said video signal every display line on said display panel; and changing the number of said divisional display periods in said unit display period in accordance with the luminance distribution every display line.

2. A display panel driving method according to claim 1, wherein said luminance distribution is calculated based on an accumulated frequency of each luminance level in said video signal of one display line.

3. A display panel driving method according to claim 1, further comprising:

performing a reset stage for initializing all said pixel cells to one of said light emitting cell and non-light emitting cell states only in said divisional display period at the beginning of said unit display period; and setting said pixel cells into one of said non-light emitting cell and light emitting cell states only in said pixel data writing stage in one of said divisional display periods.

4. A display panel driving method according to claim 1, further comprising:

performing a reset stage for initializing all said pixel cells to one of said light emitting cell and non-light emitting cell states only in said divisional display period at the beginning of said unit display period; and setting said pixel cells into one of said non-light emitting cell and light emitting cell states only in said pixel data writing stage in one of said divisional display periods, and again setting said pixel cells into said one state in said pixel data writing stage in at least one divisional display period which exists after said one divisional display period.

5. A display panel driving method according to claim 1, wherein the number of said divisional display periods is increased when said luminance distribution in said video signal of one display line extends a wider luminance range than when said luminance distribution extends a narrower luminance range.

6. A display panel driving method for driving a display panel having a plurality of pixel cells arranged in matrix in accordance with a video signal, said method comprising:

performing, in each of a plurality of divisional display periods constituting a unit display period in said video signal, a pixel data writing stage for setting each of said pixel cells to either a light emitting cell or a non-light emitting cell in accordance with pixel data corresponding to said video signal, and a light emission sustain stage for causing only said light emission cells to emit light a number of light emissions allocated thereto corresponding to a weighting factor applied to each of said divisional display periods;

obtaining a luminance distribution of said video signal every plurality of display lines on said display panel; and changing the number of divisional display periods in said unit display period in accordance with the luminance distribution every plurality of display lines.

7. A display panel driving method according to claim 6, wherein said luminance distribution is calculated based on an accumulated frequency of each luminance level in the video signal of a plurality of display lines.

8. A display panel driving method according to claim 6, further comprising:

performing a reset stage for initializing all said pixel cells to one of said light emitting cell and non-light emitting cell stages only in said divisional display period at the beginning of said unit display period; and setting said pixel cells into one of said non-light emitting cell and light emitting cell states only in said pixel data writing stage in one of said divisional display periods.

9. A display panel driving method according to claim 6, further comprising:

performing a reset stage for initializing all said pixel cells to one of said light emitting cell and non-light emitting cell states only in said divisional display period at the beginning of said unit display period; and setting said pixel cells into one of said non-light emitting cell and light emitting cell states only in said pixel data writing stage in one of said divisional display periods, and again setting said pixel cells into said one state in said pixel data writing stage in at least one divisional display period which exists after said one divisional display period.

10. A display panel driving method according to claim 6, wherein the number of said divisional display periods is increased when said luminance distribution in said video signal of plurality of display lines extends a wider luminance range than when said luminance distribution extends a narrower luminance range.

11. A display panel driving method for driving a display panel having a plurality of pixel cells arranged in matrix in accordance with a video signal, said method comprising:

performing, in each of a plurality of divisional display periods constituting a unit display period in said video signal, a pixel data writing stage for setting each of said pixel cells to either a light emitting cell or a non-light emitting cell in accordance with pixel data corresponding to said video signal, and a light emission sustain stage for causing only said light emission cells to emit light a number of light emissions allocated thereto corresponding to a weighting factor applied to each of said divisional display periods;

obtaining a luminance distribution of said video signal every plurality of display lines on said display panel; and changing the number of said divisional display periods in said unit display period in accordance with the luminance distribution every display line.

12. A display panel driving method according to claim 11, wherein said luminance distribution is calculated based on an accumulated frequency of each luminance level in the video signal of a plurality of display lines.

13. A display panel driving method according to claim 11, further comprising:

performing a reset stage for initializing all said pixel cells to one of said light emitting cell and non-light emitting cell stages only in said divisional display period at the beginning of said unit display period; and setting said pixel cells into one of said non-light emitting cell and light emitting cell states only in said pixel data writing stage in one of said divisional display periods.

14. A display panel driving method according to claim 11, further comprising:

performing a reset stage for initializing all said pixel cells to one of said light emitting cell and non-light emitting cell stages only in said divisional display period at the beginning of said unit display period; and setting said pixel cells into one of said non-light emitting cell and light emitting cell states only in said pixel data writing stage in one of said divisional display periods, and setting said pixel cells again into said one state in said pixel data writing stage in at least one divisional display period which exists after said one divisional display period.

15. A display panel driving method according to claim 11, wherein the number of said divisional display periods is increased when said luminance distribution in said video signal of a plurality of display lines extends a wider luminance range than when said luminance distribution extends a narrower luminance range.

* * * * *